US006608539B2

(12) United States Patent
Nobutoki et al.

(10) Patent No.: US 6,608,539 B2
(45) Date of Patent: Aug. 19, 2003

(54) ELECTROMAGNET DRIVING APPARATUS AND ELECTROMAGNETIC RELAY

(75) Inventors: Kazuhiro Nobutoki, Kadoma (JP); Kazuaki Nishimura, Kadoma (JP); Shunsuke Egashira, Kadoma (JP)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/818,839

(22) Filed: Mar. 28, 2001

(65) Prior Publication Data

US 2001/0028291 A1 Oct. 11, 2001

(30) Foreign Application Priority Data

Mar. 28, 2000 (JP) ..... 2000-089923
Mar. 28, 2000 (JP) ..... 2000-089924
Nov. 27, 2000 (JP) ..... 2000-359232

(51) Int. Cl.[7] ..... H01H 51/22

(52) U.S. Cl. ..... 335/78; 335/80; 335/128

(58) Field of Search ..... 335/78–86, 124, 335/128, 129–132

(56) References Cited

U.S. PATENT DOCUMENTS 5,548,259 A * 8/1996 Ide et al. ..... 335/78
5,880,653 A * 3/1999 Yamada et al. ..... 335/78

* cited by examiner

*Primary Examiner*—Lincoln Donovan
(74) *Attorney, Agent, or Firm*—Oblon, Spivak, McClelland, Maier & Neustadt, P.C.

(57) ABSTRACT

A permanent magnet 24 is stood vertically at a position shifted on way off the central position of a central piece 20*c* for a U-shaped iron core 20. An armature 50 has a projection 54 as a fulcrum at an off-centered position so that the fulcrum is placed on an upper end face of the permanent magnet 24. Also, a coil 41 is wounded around a pole piece 20*b* of the iron core 20 on a near side to the central position.

11 Claims, 26 Drawing Sheets

FIG.1(b)
FIG.1(a)
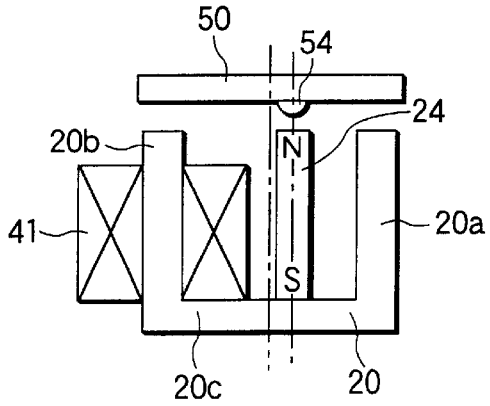
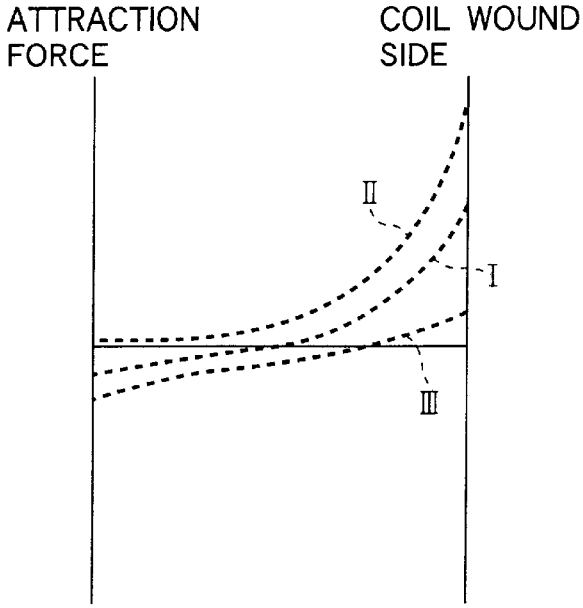

ELECTROMAGNET DRIVING APPARATUS AND ELECTROMAGNETIC RELAY

RELATED APPLICATIONS

Ser. No. 09/695,107, Electromagnetic Driving Apparatus and Electromagnetic Relay, filed Oct. 25, 2000, now Pat. No. 6,426,689.

BACKGROUND OF INVENTION

1. Field of Invention

The present invention relates to an electromagnet driving apparatus and an electromagnetic relay by the use of a permanent magnet.

2. Related Art

Conventionally, there was an electromagnet driving apparatus for use with a bistable electromagnetic relay that was constituted as shown in FIG. 31(*a*). In FIG. 31(*a*), there is constituted an 2*a* or 2*b* type electromagnetic relay, in which a U-shaped iron core 1 has a permanent magnet 2 vertically erected from the center of a central piece 1*c* in the iron core 1, an armature 3 has both end portions opposed to the pole faces for the pole pieces 1*a,* 1*b* defined by side pieces on both sides of the iron core 1, the armature 3 being freely movable in seesaw motion around the fulcrum of a projection 5 provided centrally on a lower face of the armature 3 on an upper end face of the permanent magnet 2, the armature 3 carrying the contact springs 4*a,* 4*b* with respective free ends extending in the direction toward both ends of said armature, the contact springs 4*a,* 4*b* having the moving contacts 6*a,* 6*b* on the lower face at their tip that are opposed to the fixed contacts 7*a,* 7*b,* in which a seesaw motion of the armature 3 enables one contact part to be turned on, and the other contact part to be turned off. In this case, an exciting coil is wounded centrally around the central piece 1*c* of the iron core 1, for example.

An operation state of the armature 3 is kept by the magnetic poles of the permanent magnet 2 even if an exciting current for the coil is turned off. In the reverse operation, the coil is excited in a direction of canceling a attraction force of the permanent magnet 2 on the adsorption side, and the armature 3 is reversely operated around the fulcrum of the armature 3 owing to a return force of a hinge spring and an attraction force acting on the opposite end portion of the armature 3, so that the contact in the on state is turned off, and the contact in the off state is turned on.

In this electromagnetic relay, the spring load (X) is symmetrical, the attraction force characteristic (I) with the permanent magnet 2 at the time of no excitation is also symmetrical, and operation attraction characteristic (II) and the reverse operation attraction force characteristic (III) are symmetrical, as shown in FIG. 31(*b*).

By the way, when the 2*a*(1*a*) type electromagnetic relay is constituted using the same electromagnet driving apparatus, a contact spring 4*a* is provided only on one side, as shown in 32A.

Accordingly, the spring load characteristic (X) is asymmetrical, as shown in FIG. 32(*b*). In this case, when an exciting current is passed through the coil to keep the on operation state, the operating voltage is increased, while in a self-holding mode with a magnetic force of the permanent magnet 2, the set voltage (for turning on the operation) is increased.

In order to solve a problem of FIGS. 32(*a*) and (*b*), if a coil 8 is wounded around a pole piece 1*b* on the side of a contact spring 4*b,* as shown in FIG. 33(*a*), an exciting attraction force on the side where the coil is wounded is increased, the width of attraction force being broadened with respect to the attraction force at the time of no excitation, but the attraction force characteristic at the time of no excitation remains symmetrical. Hence, there is the unsolved problem that it is difficult to be matched with the asymmetrical spring load.

FIG. 34 is an exploded perspective view of a 2*a* or 2*b* another balance armature conventional electromagnetic relay. In this conventional example, a case 117 is covered on an armature block B3 incorporated with a body block B2.

As shown in FIG. 35(*a*), the body block B2 is fabricated in such a way that a central piece of a U-shaped iron core 101 is contained into a coil bobbin 102 for winding a coil 103 by insert molding, a permanent magnet 104 is bridged between the pole pieces 101*a,* 101*b* on both sides of the iron core 101 to perform a coil block B1, this coil block B1 being incorporated in a predetermined region of a metallic hoop member formed with a coil terminal plate 105, a fixed terminal plate 107 with a fixed contact 106, and a common terminal plate 108 by punching, the coil terminal plate 105 being welded to a coil terminal 109 jutting out of the coil bobbin a body 110 consisting of a resin molding is formed by insert molding so as to bury partially the coil block B1, the common terminal plate 108, the fixed contact terminal plate 107 and the coil terminal plate 105, a terminal part of each terminal plate 108, 107, 105 being extended out of this body 110, a common terminal fixture 111 provided in the fixed contact 106 and the common terminal plate 108 being exposed as a block, and then the terminal parts are severed and separated from the metallic hoop member, each terminal part projecting on an upper end side of the body 110 being bent and arranged on a bottom face side of the body 110.

An armature block B3 comprises, as one block, an armature 112 made of a magnetic material, a molding 113 into which a central part of the armature 112 is inserted, a contact spring 115 with a moving contact 114, and a common spring 116 serving as a hinge spring formed integrally with this contact spring 115, the molding 113 having the contact spring 115 and the common spring 116 being inserted into the molding 113 and secured therein, as shown in FIG. 34.

By the way, in the conventional electromagnetic relay as described above, the entire coil block B1 was sealed and shaped with the resin molding 108 to form an insulating wall between the coil 103 and the fixed contact 106, and secure an insulation distance. Therefore, the manufacturing process was complex, and it was necessary to regulate or limit the temperature conditions such as the temperatures of the metal mold or the molding resin, the pressure conditions such as the molding injection pressure, and the molding conditions such as the limited injection position to prevent the molding resin from being applied to the coil at or near right angles when injecting the molding resin, thereby not to apply stress on the coil 103 at the time of molding, because the coil 103 is integrally molded.

SUMMARY OF INVENTION

This invention has been achieved in the light of the above respects, and it is an object of the invention to provide an electromagnet driving apparatus which is easily matched with the spring load characteristic even if used as a driver for the equipment with an asymmetrical spring load, wherein the width between an exciting attraction force and a non-exciting attraction force can be broadened by making the attraction forces at the time of excitation and no excitation asymmetrical, and an electromagnetic relay having a stable performance that can be easily matched with the asymmetrical spring load in constituting a 2*a*(1*a*) type relay.

Another object of the invention to provide an electromagnetic relay which can be easily produced without requiring the adjustments or limitations of the molding conditions, in which the basic size between a pole face of an iron core and a fixed contact can be attained at high precision.

To accomplish the above-mentioned problems, according to a first aspect of the present invention, there is provided an electromagnet driving apparatus comprising an iron core of substantial U-shape having the pole piece in parallel on both sides thereof, at least one coil wounded around said iron core, an armature freely movable in seesaw motion around a fulcrum provided between both ends of said armature, which are opposed to the pole faces at the top of the pole pieces on both sides of said iron core, and a permanent magnet for making up a closed magnetic circuit of any one end of said armature and said iron core via a pole face at the top of a pole piece of said iron core corresponding to said one end to attract one end of said armature to the corresponding pole face at the top of said pole piece of said iron core, in which said armature can be reversed by passing an exciting current through said coil in a direction canceling a magnetic force of said permanent magnet, provided that said permanent magnet and said fulcrum for said armature are provided at a position off the center between said pole piece on both sides of said iron core. As constituted in the above-described way, wherein the permanent magnet and the fulcrum of the armature are provided at an off-centered position between the pole pieces on both sides of the iron core. Therefore, there is the effect that the electromagnet driving apparatus with a greater width between the attraction force at the time of excitation and the attraction force at the time of no excitation can be realized by making the attraction force at the time of no excitation asymmetrical.

According to a second aspect of the invention, there is provided the electromagnet driving apparatus as defined in the first aspect of the present invention, wherein the permanent magnet having both ends magnetized to different magnetic poles is employed, with one end of the permanent magnet being placed on the lateral piece of the iron core to make the lengthwise direction of the permanent magnet parallel to the pole pieces of the iron core, and the fulcrum of the armature is placed at the other end. Therefore, there is the effect that the attraction force characteristic can be made asymmetrical more easily.

According to a third aspect of the present invention, there is provided the electromagnetic driver as defined in the first aspect of the present invention, wherein the permanent magnet having both ends magnetized to different magnetic poles is employed, with one end of the permanent magnet being placed on the lateral piece of the iron core at a position off the center between the pole pieces on both sides of the iron core to make the lengthwise direction of the permanent magnet parallel to the pole pieces of the iron core, and the fulcrum of the armature is placed on a line passing through the center between the pole pieces on both sides of the iron core. When used for the electromagnetic relay, the attraction force on the normally closed side can be increased without changing the attraction force on the normally open side, and the attraction force characteristic can be unbalanced. Therefore, there is the effect that the electromagnetic driver can be easily matched with the asymmetrical spring load.

According to a fourth aspect of the present invention, there is provided the electromagnetic driver as defined in the first aspect of the present invention, wherein the permanent magnet having both ends magnetized to different magnetic poles is employed, with one end of the permanent magnet being placed on the lateral piece of the iron core at a position off the center between the pole pieces on both sides of the iron core to make the lengthwise direction of the permanent magnet parallel to the pole pieces of the iron core, and the fulcrum of the armature is placed between the central position between the pole pieces on both sides of the iron core and an arranged position of the permanent magnet. When the electromagnetic driver is incorporated into the electromagnetic relay, the attraction force on the normally open side can be increased and the attraction force on the normally closed side reduced. Therefore, there is the effect that the electromagnetic driver can be easily matched with the asymmetrical spring load in the design of the simple type in particular (as current holding type, while flowing the current, it turned on the closed condition).

According to a fifth aspect of the present invention, there is provided the electromagnetic driver as defined in the first aspect of the present invention, wherein the permanent magnet having both ends magnetized to different magnetic poles is employed, with one end of the permanent magnet being placed on the lateral piece of the iron core at a position off the center between the pole pieces on both sides of the iron core to make the lengthwise direction of the permanent magnet parallel to the pole pieces of the iron core, and the fulcrum of the armature is placed between the pole piece of the iron core on a far side from an arranged position of the permanent magnet and the central position between the pole pieces on both sides. Therefore, there is the effect that the attraction force characteristic can be further unbalanced, and the electromagnetic driver can be easily matched with the asymmetrical spring load in the design of the simple type in particular.

According to a six aspect of the present invention, there is provided the electromagnetic driver as defined in the first aspect of the present invention, wherein the permanent magnet having both ends magnetized to different magnetic poles is employed, with one end of the permanent magnet being placed on the lateral piece of the iron core at a position off the center between the pole pieces on both sides of the iron core to make the lengthwise direction of the permanent magnet parallel to the pole pieces of the iron core, and the fulcrum of the armature is placed between an arranged position of the permanent magnet and the pole piece of the iron core on a near side to the arranged position. Therefore, there is the effect that the attraction force characteristic can be further unbalanced, and a large space for winding the coil can be secured.

According to seventh aspect of the present invention, there is provided the electromagnetic driver as defined in the first aspect of the present invention, wherein the permanent magnet having both ends magnetized to different magnetic poles is employed, with one end of the permanent magnet being placed on the lateral piece of the iron core corresponding to the center between the pole pieces on both sides of the iron core to make the lengthwise direction of the permanent magnet parallel to the pole pieces of the iron core, and the fulcrum of the armature is placed at a position shifted to the side of one pole piece off the central position between the pole pieces of the iron core. Therefore, there is the effect that the attraction force characteristic can be further unbalanced, while a large space for winding the coil can be effectively secured.

According to an eighth aspect of the present invention, there is provided the electromagnetic driver as defined in the first aspect of the present invention, wherein the permanent magnet having both ends magnetized to the same magnetic pole and an intermediate part off the center in the lengthwise direction to a different magnetic pole is employed, the permanent magnet is bridged to make both ends contact with the inner side faces at the tip of the pole pieces on both sides of the iron core. Therefore, there is the effect that the asymmetrical attraction force characteristic can be easily realized only by dislocating the magnetized position in the intermediate part of the permanent magnet.

According to a ninth aspect of the present invention, there is provided the electromagnetic driver as defined in the first aspect of the present invention, wherein the permanent magnet having both ends magnetized to the same magnetic pole and an intermediate part off the center in the lengthwise direction to a different magnetic pole is employed, the permanent magnet is bridged to make both ends contact with the inner side faces at the tip of the pole pieces on both sides of the iron core, and the fulcrum of the armature is placed at a corresponding position on a line passing through the center between the pole pieces on both sides of the iron core. When the electromagnetic driver is used for the electromagnetic relay, the attraction force on the normally closed side can be increased without changing the attraction force on the normally open side. Therefore, there is the effect that the attraction force characteristic can be unbalanced and the electromagnetic driver can be easily matched with the asymmetrical spring load.

According to a tenth aspect of the present invention, there is provided the electromagnetic driver as defined in the first aspect of the present invention, wherein the permanent magnet having both ends magnetized to the same magnetic pole and an intermediate part off the center to a different magnetic pole is employed, the permanent magnet is bridged to make both ends contact with the inner side faces at the tip of the pole pieces on both sides of the iron core, and the fulcrum of the armature is placed between the central position between the pole pieces on both sides of the iron core and the magnetized position in the intermediate part of the permanent magnet. When the electromagnetic driver is incorporated for the electromagnetic relay, the attraction force on the normally open side can be increased and the attraction force on the normally closed side can be reduced. Therefore, there is the effect that the electromagnetic driver can be easily matched with the asymmetrical spring load in the design of the simple type in particular.

According to an eleventh aspect of the present invention, there is provided the electromagnetic driver as defined in the first aspect of the present invention, wherein the permanent magnet having both ends magnetized to the same magnetic pole and an intermediate part of the center in the lengthwise direction to a different magnetic pole is employed, the permanent magnet is bridged to make both ends contact with the inner side faces at the tip of the pole pieces on both sides of the iron core, and the fulcrum of the armature is placed between the central position between the pole pieces on both sides of the iron core and the pole piece on a far side from the magnetized position in the intermediate part of the permanent magnet. Therefore, there is the effect that the attraction force characteristic can be further unbalanced, and the electromagnetic driver can be easily matched with the asymmetrical spring load in the design of the simple type in particular.

According to a twelfth aspect of the present invention, there is provided the electromagnetic driver as defined in the first aspect of the present invention, wherein the permanent magnet having both ends magnetized to the same magnetic pole and an intermediate part off the center in the lengthwise direction to a different magnetic pole is employed, the permanent magnet is bridged to make both ends contact with the inner side faces at the tip of the pole pieces on both sides of the iron corner and the fulcrum of the armature is placed between the magnetized position in the intermediate part of the permanent magnet and the pole piece of the iron core on a near side to the magnetized position. Therefore, there is the effect that the attraction force characteristic can be unbalanced without worrying about the space for winding the coil.

According to a thirteenth aspect of the present invention, there is provided the electromagnetic driver as defined in the first aspect of the present invention, wherein the permanent magnet having both ends magnetized to the same magnetic pole and a central part in the lengthwise direction to a different magnetic pole is employed, the permanent magnet is bridged to make both ends contact with the inner side faces at the tip of the pole pieces on both sides of the iron core, and the fulcrum of the armature is placed at a position shifted to the side of one pole piece off the central position between the pole pieces on both sides of the iron core. Therefore, there is the effect that the attraction force characteristic can be unbalanced without worrying about the space for winding the coil.

According to a fourteenth aspect of the present invention, there is provided the electromagnetic driver as defined in the first aspect of the present invention, wherein the permanent magnet is attached integrally in parallel to the armature, and is not disposed on the side of the iron core, so that the space occupied by the coil wounded around the iron core can be increased. Therefore, there is the effect that the number of turns of the coil can be increased.

According to a fifteenth aspect of the present invention, there is provided the electromagnetic driver as defined in the first aspect of the present invention, wherein the permanent magnet is attached to the armature so that the central position of the permanent magnet is shifted off a line passing through the center between the pole pieces on both sides of the iron core, and the fulcrum of the armature is placed on a line passing through the center between the pole pieces on both sides of the iron core. When the electromagnetic driver is used for the electromagnetic relay, the attraction force on the normally closed side can be increased without changing the attraction force on the normally open side. Therefore, there is the effect that the attraction force characteristic can be unbalanced, and the electromagnetic driver can be easily matched with the asymmetrical spring load.

According to a sixteenth aspect of the present invention, there is provided the electromagnetic driver as defined in the first aspect of the present invention, wherein the permanent magnet is attached to the armature so that the central position of the permanent magnet is shifted off a line passing through the center between the pole pieces on both sides of the iron core, and the fulcrum of the armature is placed at a shifted position between a line passing through the center between the pole pieces on both sides of the iron core and the central position of the permanent magnet. When the electromagnetic driver is incorporated into the electromagnetic relay, the attraction force on the normally open side can be increased and the attraction force on the normally closed side can be reduced. Therefore, there is the effect that the electromagnetic driver can be easily matched with the asymmetrical spring load.

According to a seventeenth aspect of the present invention, there is provided the electromagnetic driver as defined in fourteenth aspect of the present invention, wherein the permanent magnet is attached to the armature so that the central position of the permanent magnet is shifted off a line passing through the center between the pole pieces on both sides of the iron core, and the fulcrum of the armature is placed between the pole piece of the iron core on a far side from the central position of the permanent magnet and the central position between the pole pieces. Therefore, there is the effect that the attraction force characteristic can be further unbalanced, and the electromagnetic driver can be easily matched with the asymmetrical spring load.

According to an eighteenth aspect of the present invention, there is provided the electromagnetic driver as defined in fourteenth aspect of the present invention, wherein the permanent magnet is attached to the armature so that the central position of the permanent magnet is shifted off a line passing through the center between the pole pieces on both sides of the iron core, and the fulcrum of the armature is placed at a corresponding position between the central position of the permanent magnet and the pole piece of the iron core on a near side to the central position of the permanent magnet. Therefore, there is the effect that the attraction force characteristic can be unbalanced without worrying about the space for winding the coil.

According to a nineteenth aspect of the present invention, there is provided the electromagnetic driver as defined in fourteenth aspect of the present invention, wherein the permanent magnet is attached to the armature so that the magnetized position at the center of the permanent magnet is located on a line passing through the center between the pole pieces on both sides of the iron core, and the fulcrum of the armature is placed at a position shifted to the side of one pole piece of the iron core. Therefore, there is the effect that the attraction force characteristic can be unbalanced without worrying about the space for winding the coil.

According to a twentieth aspect of the present invention, there is provided the electromagnetic driver as defined in any one of first to sixth, eighth to eighteenth aspects of the present invention, wherein only one coil is provided. Therefore, there is the effect that the asymmetrical attraction force in an excited state can be secured.

According to a twenty-first aspect of the present invention, there is provided the electromagnetic driver as defined in the twentieth aspect of the present invention, wherein the coil is wounded around the iron core from the position at which the fulcrum of the armature is shifted to the position including the pole piece present in a central direction. Therefore, there is the effect that the width of the attraction force on the side where the coil is wounded can be increased.

According to a twenty-second aspect of the present invention, there is provided the electromagnetic driver as defined in any one of first to nineteenth aspects of the present invention, wherein the coil is wounded around the iron core from the position at which the fulcrum of the armature is shifted to the position including the pole pieces on both sides. Therefore, there is the effect that the width of the attraction force on both sides of the fulcrum can be increased.

According to a twenty-third aspect of the present invention, there is provided an electromagnetic relay comprising an electromagnet block having an iron core of substantial U-shape having the pole piece in parallel on both sides thereof, at least one coil wounded around said iron core, an armature freely movable in seesaw motion around a fulcrum provided between both ends of said armature, which are opposed to the pole faces at the top of the pole pieces on both sides of said iron core, and a permanent magnet for making up a closed magnetic circuit of any one end of said armature and said iron core via a pole face at the top of a pole piece of said iron core corresponding to said one end to attract one end of said armature to the corresponding pole face at the top of said pole piece of said iron core, said electromagnet block being disposed on a body, in which said armature has a contact spring extending in parallel to said armature with one end being attached to said armature, a moving contact at the other end of said contact spring extending in an end direction of said armature being opposed to a fixed contact on said body, said contact spring enabling said moving contact to be touched on or left away from said fixed contact in accordance with the seesaw motion of said armature, said armature being able to be reversed by passing an exciting current through said coil in a direction canceling a magnetic force of said permanent magnet, wherein said armature and the fulcrum for said permanent magnet are provided at a position off the center between said pole pieces on both sides of said iron core, shifted in an opposite direction to the end direction of said contact spring. As constituted in the above way, wherein the permanent magnet and the fulcrum of the armature are provided at a position shifted in an opposite direction to the end direction of the contact spring off the center between the pole pieces on both sides of the iron core. Therefore, there is the effect that the electromagnetic relay can be realized in which the asymmetrical attraction force can be provided, and the electromagnetic relay can be easily matched with the asymmetrical spring load having the contact spring on one side.

According to a twenty-fourth aspect of the present invention, there is provided the electromagnetic relay as defined in the twenty-third aspect of the present invention, wherein the permanent magnet having both ends magnetized to different magnetic poles is employed, with one end of the permanent magnet being placed on the lateral piece of the iron core to make the lengthwise direction of the permanent magnet parallel to the pole pieces of the iron core, and the fulcrum of the armature is placed at the other end. Therefore, there is the effect that the asymmetrical attraction force characteristic can be provided easily.

According to a twenty-fifth aspect of the present invention, there is provided the electromagnetic relay as defined in the twenty-third aspect of the present invention, wherein the permanent magnet having both ends magnetized to different magnetic poles is employed, with one end of the permanent magnet being placed at a position off the center between the pole pieces on both sides of the iron core to make the lengthwise direction of the permanent magnet parallel to the pole pieces of the iron core, and the fulcrum of the armature is placed on a line passing through the center between the pole pieces. Therefore, there is the effect that the asymmetrical attraction force characteristic can be provided easily.

According to a twenty-sixth aspect of the present invention, there is provided the electromagnetic relay as defined in the twenty-third aspect of the present invention, wherein the permanent magnet is attached integrally in parallel to the armature, and is not disposed on the side of the iron core, so that the space occupied by the coil wounded around the iron core can be increased. Therefore, there is the effect that the number of turns of the coil can be increased.

According to a twenty-seventh aspect of the present invention, there is provided the electromagnetic relay as defined in any one of twenty-third to twenty-sixth aspects, wherein only one coil is provided. Therefore, there is the effect that the asymmetrical attraction force characteristic in an excited state can be secured.

According to a twenty-eighth aspect of the present invention, here is provided the electromagnetic relay as defined in any one of twenty-third to twenty-sixth aspects, wherein the coil is wounded around the iron core from the position at which the fulcrum of the armature is shifted to the position including the pole piece present in a central direction. Therefore, there is the effect that the attraction force characteristic can be secured so that the electromagnetic relay can be easily matched with the asymmetrical spring load.

According to a twenty-ninth aspect of the present invention, there is provided the electromagnetic relay as defined in any one of twenty-third to twenty-sixth aspects, wherein the coil is wounded around the iron core from the position at which the fulcrum of the armature is shifted to the position including the pole pieces on both sides. The width of the attraction force on both sides of the fulcrum can be increased. Therefore, there is the effect that the attraction force characteristic can be secured so that the electromagnetic relay can be easily matched with the asymmetrical spring load.

According to thirtieth aspect of the present invention, there is provided the electromagnetic relay as defined in any one of twenty-third to twenty-ninth aspects, wherein a hinge spring has one end secured to the armature in an opposite direction to the other end direction of the contact spring, the other end being secured on the body. The space for arranging the hinge spring is secured and utilized by making use of the dead space. Therefore, there is the effect that the small electromagnetic relay can be produced.

According to a thirty-first aspect of the present invention, there is provided the electromagnetic relay as defined in the thirtieth aspect of the present invention, wherein the hinge spring is substantially U-shaped, at least the plate face on both side pieces being in the same direction as the plate face of the contact spring, the tip of one side piece being secured to the armature, the other side piece being disposed laterally and in parallel to the armature to allow its tip to be secured on the body. Therefore, there is the effect that the spring can be adjusted by shifting the central piece.

According to a thirty-second aspect of the present invention, there is provided the electromagnetic relay as defined in thirty-first aspect of the present invention, wherein the central piece of the hinge spring is bent to make its plate face perpendicular to the plate face of both side pieces. The spring adjustment can be made by picking up and shifting the central piece from above by means of an adjuster. Therefore, there is the effect that the spring adjustment can be easily made.

According to thirty-third aspect of the present invention, there is provided the electromagnetic relay as defined in any one of thirtieth to thirty-second aspect of the present invention, wherein the position at which the hinge spring is secured on the body is near the fulcrum position of the armature, where the perturbation of the fulcrum portion can be reduced. Therefore, there is the effect that the stable operation can be obtained.

According to thirty-fourth aspect of the present invention, there is provided an electromagnetic relay comprising an iron core of an electromagnetic drive mechanism for driving an armature and a contact terminal having a fixed contact that is touched on or separated from a moving contact of a contact spring that is movable by the operation of the armature, the iron core and the contact terminal being secured to a body made of a resin molding by integral molding to constitute a body block along with the body. Hence, the reference size between a pole face of the iron core and the fixed contact can be determined by the precision of a metal mold, and thus can be provided at high precision. In particular, a coil block that is fragile is not provided integrally in the body block by insert molding. Therefore, there is the effect that it is unnecessary to regulate or limit the molding conditions, including the molding temperatures such as the temperature of the metal mold or the temperature of the molding resin, the pressures such as the molding injection pressure, and the limited injection position to prevent the molding resin from being applied to the coil at or near right angles.

According to the thirty-fifth aspect of the present invention, there is provided the electromagnetic relay as defined in the thirty-fourth aspect of the present invention, wherein the iron core is the punched iron core, the cast iron core or the sintered iron core. In this case, a higher precision is attained in the bent portion (corner portion) than the bent iron core, and there is no need of providing a slide core for modifying the bending on the structure of the metal mold. Therefore, there is the effect that a number of body blocks can be molded at a time.

According to the thirty-sixth aspect of the present invention, there is provided the electromagnetic relay as defined in the thirty-fourth to thirty-fifth aspects of the present invention, wherein the iron core has a substantial U-shape, the pole pieces on both sides are secured to the body by integral molding to be exposed from the body, a permanent magnet is disposed between the pole pieces on both sides to make the lengthwise direction parallel to the pole pieces, a fulcrum of the armature being laid on the top of this permanent magnet to be freely movable in seesaw motion, a closed magnetic path is constituted by any one end of the armature and the iron core via a pole face at the top of a pole piece of the iron core corresponding to this one end, in which while one end of the armature is sucked onto the corresponding pole face at the top of the pole piece of the iron core due to a magnetic force of the permanent magnet, the armature can be reversed by passing an exciting current through the coil wounded around the iron core in a direction of canceling the magnetic force of the permanent magnet. Therefore, there is the effect that the electromagnetic relay of seesaw type can be produced.

According to a thirty-seventh aspect of the present invention, there is provided the electromagnetic relay as defined in the thirty-sixth aspect of the present invention, wherein the permanent magnet is secured onto the body by integral molding. In this case, a step of incorporating the permanent magnet into the body block can be omitted, and the basic size between the pole face and the fixed contact as well as the basic size between the pole faces of the permanent magnet can be obtained at high precision. As a result, there is the effect that the armature can be stabilized in stroke.

According to a thirty-eighth aspect of the present invention, there is provided the electromagnetic relay as defined in the thirty-sixth and thirty-seventh aspect of the present invention, wherein the coil is wound around the outer periphery of a barrel portion of the coil bobbin that is laid on the body with the pole piece passed through the central through hole, constituting a coil block along with the coil bobbin, the coil bobbin being accommodated within an insulating case to cover the coil, the insulating case being like a box with an opening at the bottom, and having, on a ceiling plane, an opening window through which the top portion of the pole piece passing through the central through hole of the coil bobbin is extended outside. In this case, the insulating distance between the coil and the other metal parts can be secured. Therefore, there is the effect that the electromagnetic relay can be miniaturized with the improved dielectric strength, and the insulating case can provide a mechanical protection for the coil during the transportation or handling of parts.

According to a thirty-ninth aspect of the present invention, there is provided the electromagnetic relay as defined in the thirty-eighth aspect of the present invention, wherein a resilient projecting piece having an engagement bore is integrally formed at least on the lower edge of each of a pair of opposed side walls for the insulating case, the engagement bore being internally engaged by an engaging projection formed on either side face of a collar portion for the coil bobbin located on the side of the body, when the insulating case is attached on the coil block. Therefore, there is the effect that the insulating case can be attached onto the coil bobbin by one touch.

According to claim fortieth aspect of the present invention, there is provided the electromagnetic relay as defined in any one of thirty-eighth and thirty-ninth aspect of the present invention, wherein a rib is provided to surround an opening of the central through hole through which the top portion of the pole piece extends, except for a region to which an end portion of the armature is faced, the rib higher than the top position of the pole piece being extended from the collar portion on the upper side of the coil bobbin, and the rib, along with the top portion of the pole piece, being extended through an opening window of the insulating case outward. In this case, a large insulation distance between the pole pieces of the iron core and the coil can be secured. And the wear powder on the pole faces of the pole pieces can be prevented from scattering, when the wear powder is produced during the opening or closing operation, and the consumed powder arising at the contact portion in the opening or closing operation can be prevented from being moved to the pole faces. Therefore, there is the effect that the stable operation can be obtained over time.

According to a forty-first aspect of the present invention, there is provided the electromagnetic relay as defined in any one of thirty-eighth to fortieth aspects, wherein a coil terminal is protruded on either side face of the collar portion in the coil bobbin to be laid on the body, the coil terminal having a top portion passed through the body and exposed to the bottom face side of the body, when the coil bobbin is laid on the body, an end portion of the collar portion being fitted within a notch formed on an upright wall stood on the outer edge of the body, and grasped between a projection on an inner wall face of the case attached on the body and the body, when the coil bobbin is laid on the body. Therefore, there is the effect that the coil bobbin can be stably secured by making use of a wall thickness of the end portion of the collar portion to extend the coil terminal for which a predetermined wall thickness is required.

According to a forty-second aspect of the present invention, there is provided the electromagnetic driving apparatus as defined in the eight aspect of the present invention, wherein the fulcrum of the armature is placed corresponding to a magnetized position in the intermediate part of the permanent magnet. Therefore, there is the effect that the asymmetrical attraction force characteristic can be easily realized only by dislocating the magnetized position in the intermediate part of the permanent magnet.

BRIEF DESCRIPTION OF DRAWINGS

FIG. 1A is a schematic view of an electromagnet driving apparatus according to a first embodiment of the present invention.

FIG. 1B is an explanatory diagram of the attraction force characteristic for the electromagnet driving apparatus.

FIGS. 2A–2B are explanatory diagrams of

FIG. 7(*b*) is a plan view of an armature block of the relay

FIG. 25(*b*) is a schematic view, partially omitted, of another example of the electromagnet driving apparatus.

FIG. 26(*b*) is a schematic view, partially omitted, of a variation example of the electromagnet driving apparatus.

FIG. 27(*b*) is a schematic view, partially omitted, of another example of the electromagnet driving apparatus.

FIG. 28(*b*) is a schematic view, partially omitted, of a variation example of the electromagnet driving apparatus.

FIG. 29(*b*) is a schematic view, partially omitted, of a variation example of the electromagnet driving apparatus.

FIG. 30(*b*) is a schematic view, partially omitted, of another example of the electromagnet driving apparatus.

FIG. 31(*b*) is an explanatory diagram of the attraction force characteristic and the spring load characteristic for the conventional bistable electromagnetic relay.

FIG. 32(*b*) is an explanatory diagram of the attraction force characteristic and the spring load characteristic for the electromagnetic relay of 2a type.

FIG. 33(*a*) is an explanatory diagram of the attraction force characteristic and the spring load characteristic for the electromagnetic relay.

DETAILED DESCRIPTION OF PREFERRED EMBODIMENTS

Figure 2A:
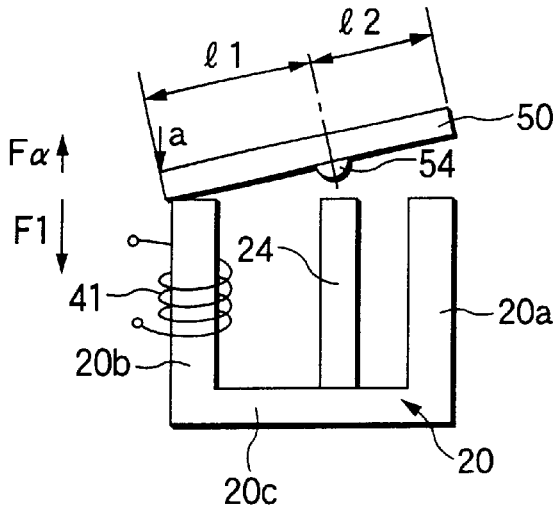

The preferred embodiments of the present invention will be described below.

First Embodiment

An electromagnet driving apparatus in a first embodiment contains a permanent magnet 24 magnetized with an S pole (or N pole) at the lower end and an N pole (or S pole) at the upper end, the permanent magnet 24 being vertically erected at an off-centered position shifted close to a pole piece 20*a* rather than a center position of a central piece 20*c* of a U-shaped iron core 20, a projection 54 acting as a fulcrum of an armature 50 in seesaw motion that is provided at an off-center position corresponding to an upper end face of the permanent magnet 24, and a coil 41 wounded around a pole piece 20*b* of the iron core 20 on a side including the center line, as shown in FIG. 1(*a*).

The attraction force characteristic of this embodiment will be described below.

First of all, in the case where a attraction force of F1 is exerted at a part a of the armature 50 in FIG. 2(*a*), a force Fα for forcing the part a of the armature 50 away from the pole piece 20*b* of the iron core 20 is given by an expression (1) as follows.

$$F\alpha = F1 \tag{1}$$

Figure 2B:
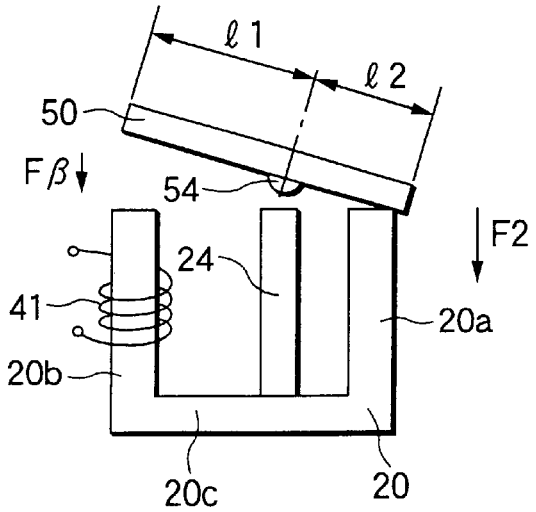

In a state where an end portion of the armature 50 is attracted to the pole piece 20*a*, as shown in FIG. 2(*b*), a force Fβ for forcing the opposite end portion in a direction attracting to the pole piece 20*b* is obtained as follows.

Herein, supposing that the distance from the fulcrum position of the armature 50 to its edge on the side of the pole piece 20*b* is $l_1$, the distance between the fulcrum position to the edge on the side of the pole piece 20*a* is $l_2$, and the attraction force on the attracting side is F2, the force Fβ is given by an expression (2) as follows.

$$F\beta \times l_1 = F2 \times l_2$$

$$F\beta = F2 \times l_2 / l_1 \tag{2}$$

Herein, in the case where the magnetic resistance within the iron core 20 and the armature 50 is negligible as compared with the magnetic resistance at a gap, the left and right attraction forces F1, F2 are considered to be equivalent.

Accordingly, from the above expressions (1) and (2), $F\alpha > F\beta$ when $l_1 < l_2$. At the time of no excitation, the attraction force is asymmetrical on the left and right sides, as shown in FIG. 3.

Figure 6A:
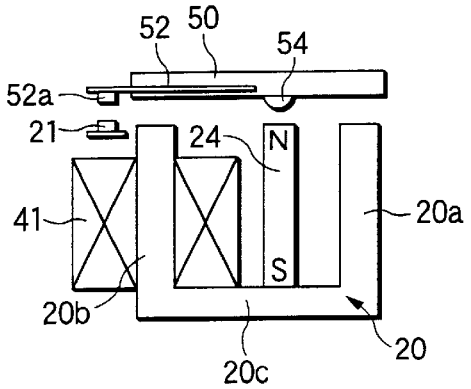
FIG. 6A is a schematic view of an electromagnetic relay according to a fourth embodiment of the invention.
Figure 6B:
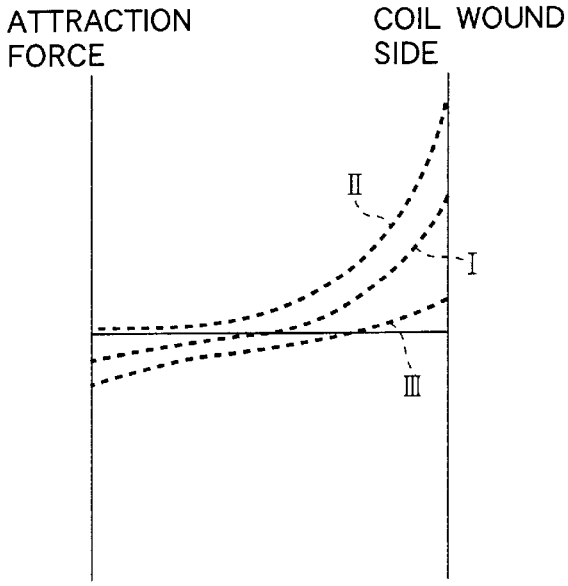
FIG. 6B is an explanatory diagram of the attraction force characteristic for the electromagnetic relay.
Figure 33A:
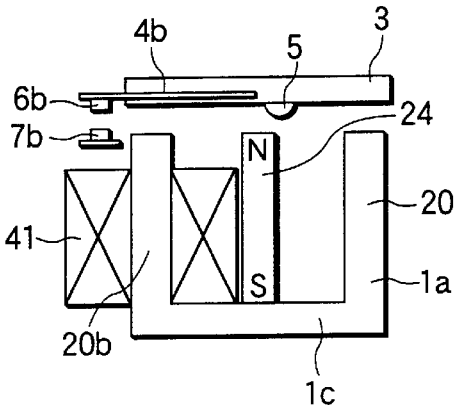
FIG. 33(*a*) is a schematic view of an electromagnetic relay that is improved from the electromagnetic relay of FIG. 31.
Figure 33B:
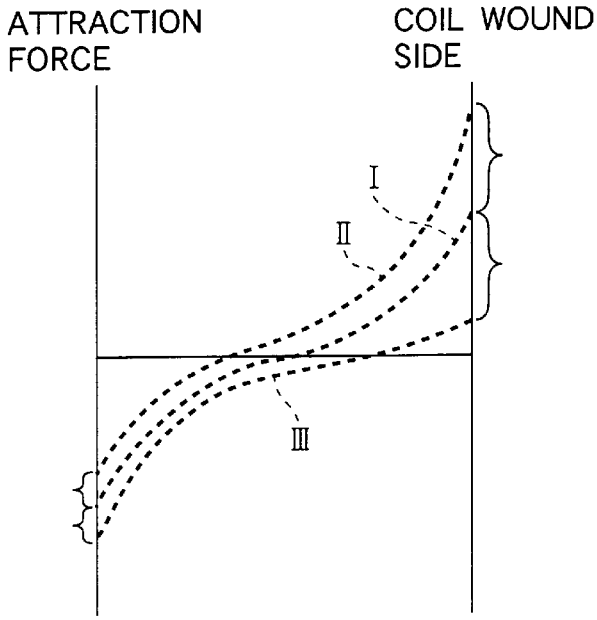
Figure 34:
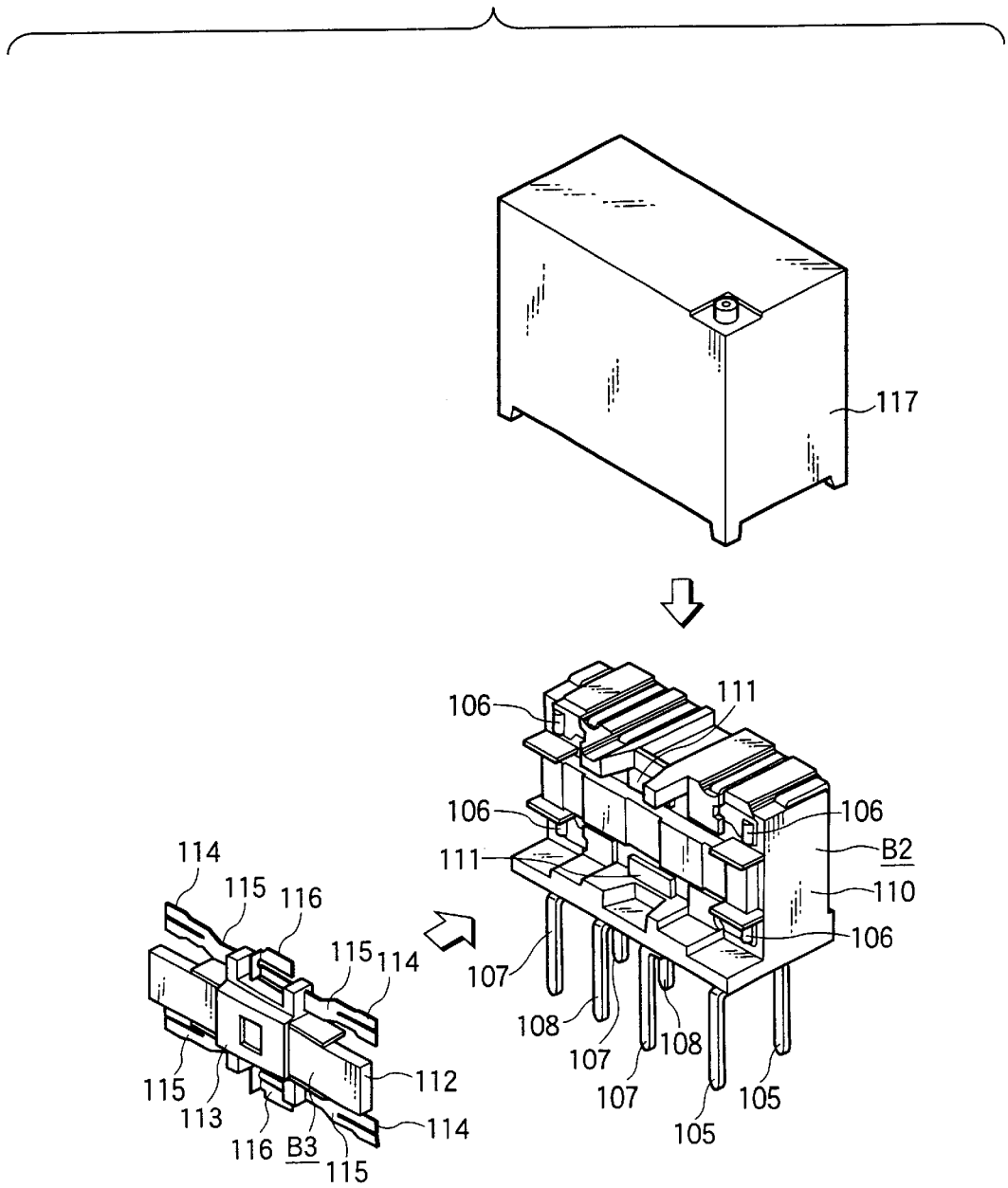
FIG. 34 is an exploded perspective view of the another conventional electromagnetic relay, FIGS. 35(*a*) to (*c*) are explanatory views of a manufacturing method for the conventional electromagnetic relay.
Figure 35A:
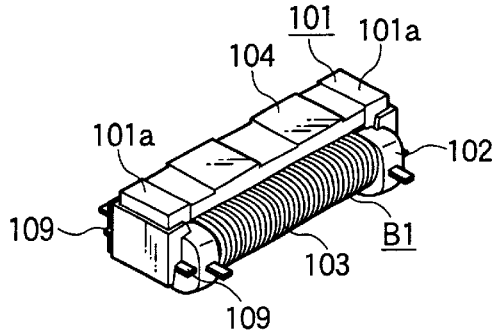
Figure 35B:
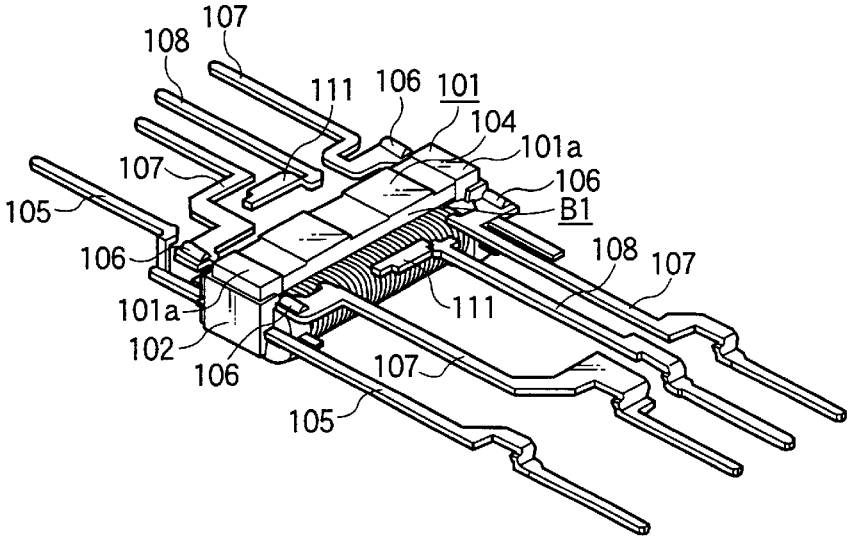
Figure 35C:
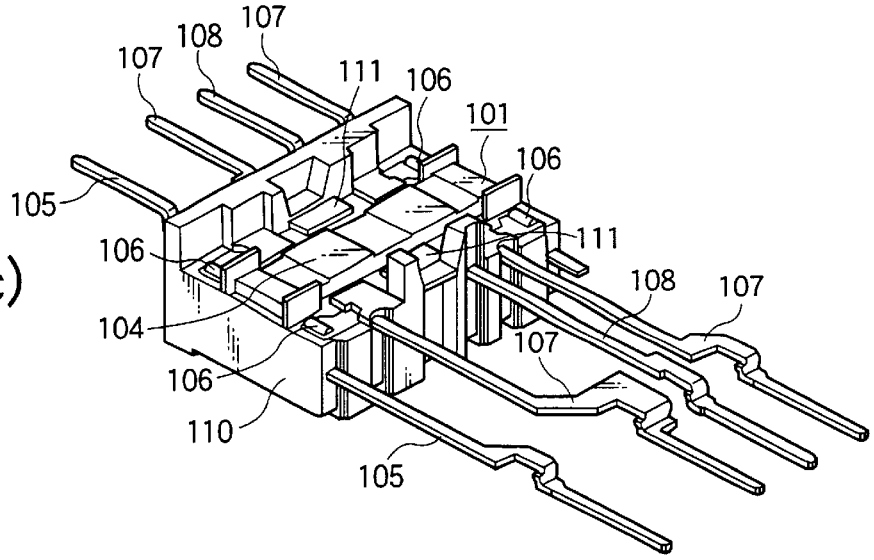

On the other hand, in the case where the permanent magnet 24 is disposed at the central position, with a coil 41 wounded around one pole piece 20*b* of the iron core 20, as described above and shown in FIG. 33(*a*), the attraction force characteristic (of the permanent magnet 24) at the time of no excitation is symmetrical on both sides of the iron core, without regard to the coil wounded, as shown at (I) in FIG. 6(*b*), but the attraction forces during the operation attraction and the return attraction owing to excitation of the coil 41 are graduated in width on the coil wounded side, as seen from the curves (II) and (III).

Figure 3:
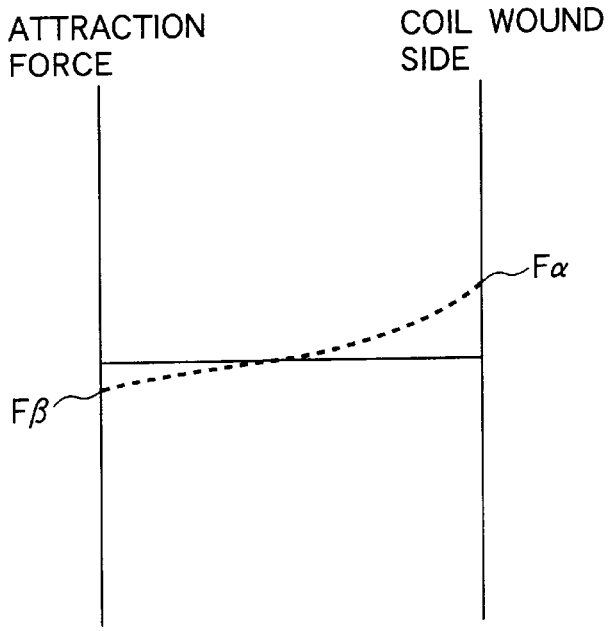
FIG. 3 is an explanatory view of the attraction force characteristic which is used for explaining the principle of the electromagnet driving apparatus.

Accordingly, in the case where the position of the permanent magnet 24 is shifted as in this embodiment, the attraction force characteristic due to the permanent magnet 24 becomes asymmetrical, as shown in FIG. 3. As a result, the attraction force characteristic is obtained as shown in FIG. 1B. Note that (I) indicates the attraction force characteristic at the time of no excitation, and (II), (III) indicates those during the operation attraction and the return attraction, respectively.

With the constitution of this embodiment, the attraction force characteristic is asymmetrical at the time of no excitation and at the time of excitation. Therefore, when an unbalanced load is applied, the electromagnet driving apparatus can be produced.

Second Embodiment

Figure 4:
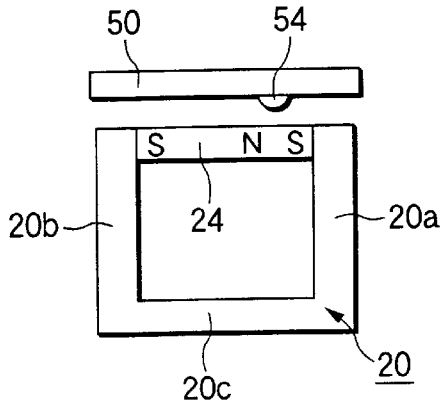
FIG. 4 is a schematic view of an electromagnet driving apparatus according to a second embodiment of the invention, partly omitted.

In a second embodiment, the permanent magnet 24 erected as in the first embodiment is not employed, but the permanent magnet 24 having both ends magnetized at the same magnetic pole and an off-centered position magnetized at a different magnetic pole is used as shown in FIG. 4, in which the permanent magnet 24 is bridged at both ends to make contact with the inner side faces at the end portion of the pole pieces 20*a,* 20*b* on both sides of the iron core 20, and a projection 54 as a fulcrum of the armature 50 is disposed at a pole position shifted from the center.

In this embodiment, the attraction force characteristics equivalent to those of the first embodiment can be obtained.

Third Embodiment

Figure 5:
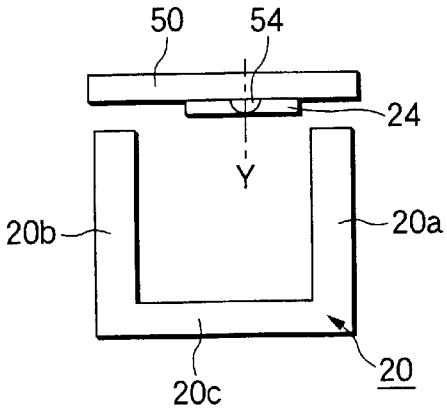
FIG. 5 is a schematic view, partially omitted, of an electromagnet driving apparatus according to a third embodiment 3 of the invention.

In a third embodiment, the permanent magnet 24 having both ends magnetized at different magnetic poles, for example, is provided on the side of the armature 50, the central position Y of the permanent magnet 24 being shifted to accord with the location of the fulcrum, as shown in FIG. 5.

Fourth Embodiment

In a fourth embodiment, a 2*a* type electromagnetic relay is constituted employing an electromagnet driving apparatus as described in the first embodiment. As shown in FIG. 6(*a*), a contact spring 52 is held on the armature 50 to be parallel to a region of the armature 50 in such a manner that the spring 52 is arranged at a side having a distance defined between the fulcrum and one end of the armature 50 longer in longitudinal direction than a distance defined between the fulcrum and the other end of armature, and has a moving contact 52*a* on the lower face at the tip of this contact spring 52*a,* the moving contact 52*a* being provided to be opposite a fixed contact 21, in which the spring load is asymmetrical. FIG. 6(*b*) shows the attraction force characteristics of this embodiment, which are in principle equivalent to those as described in the first embodiment. In FIG. 6(*b*), a curve (I) shows the attraction force characteristic at the time of no excitation, a curve (II) the attraction force characteristic at the time of attraction operation, and a curve (III) the attraction characteristic at the time of return operation. Accordingly, owing to the asymmetrical attraction force characteristics, the electromagnetic relay can be easily matched with the asymmetrical spring load.

Figure 7A:
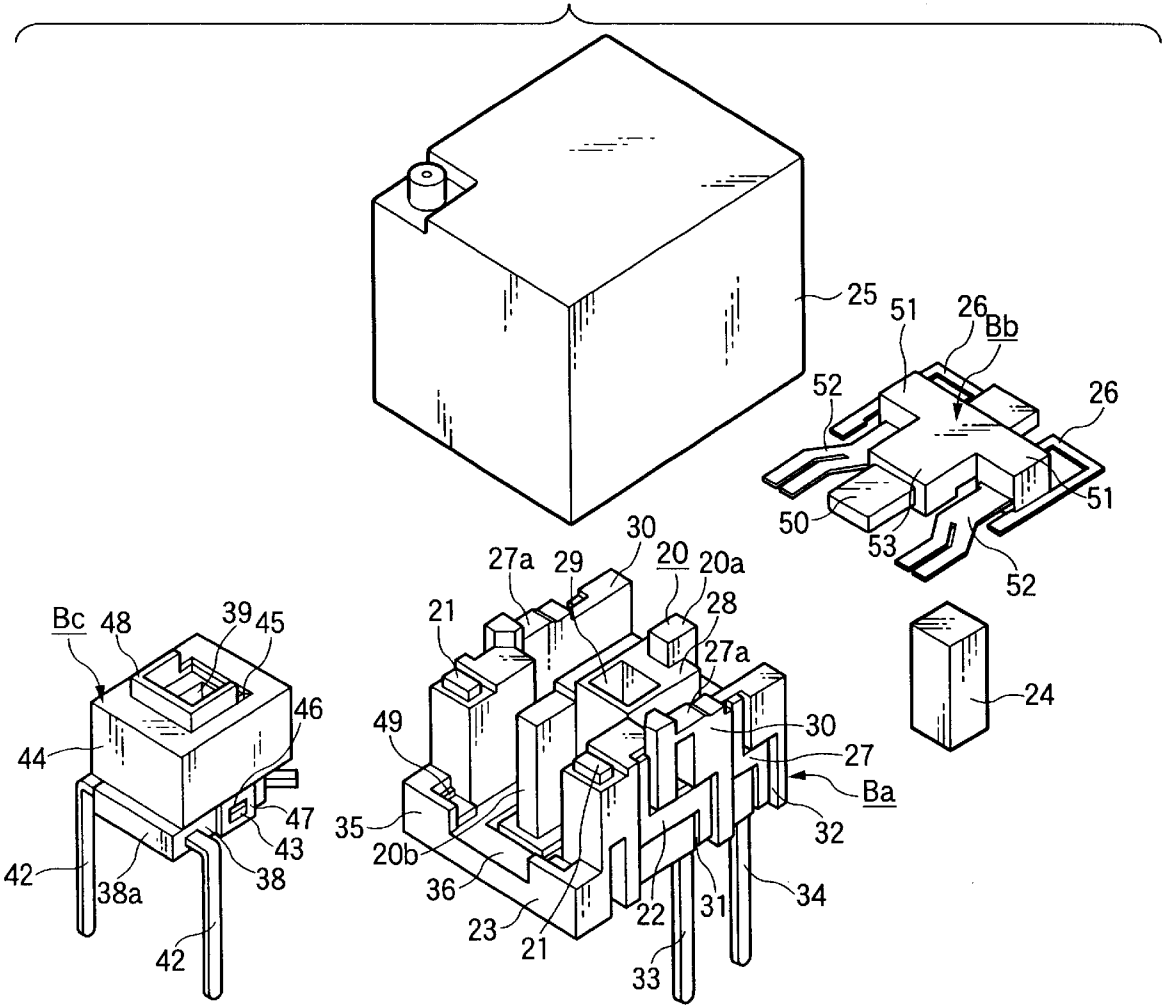
FIG. 7(*a*) is an exploded perspective view of the electromagnetic relay.
Figure 7B:
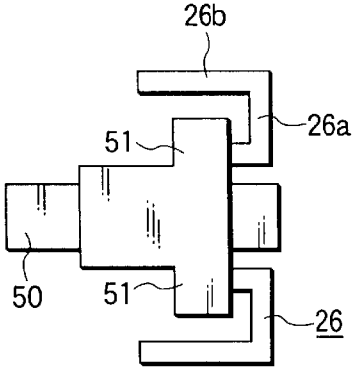
Figure 8A:
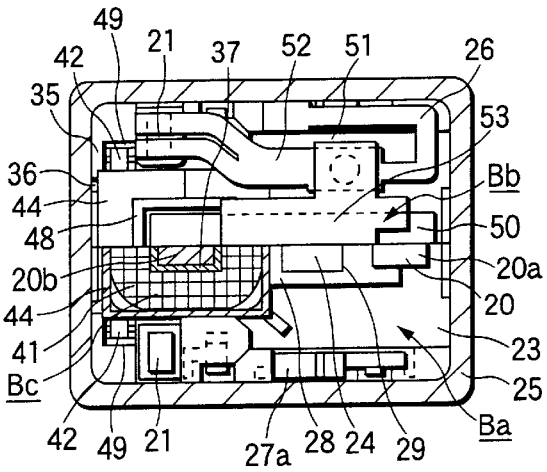
FIG. 8A is a plan cross-sectional view, partially broken away, of the electromagnetic relay.
Figure 8D:
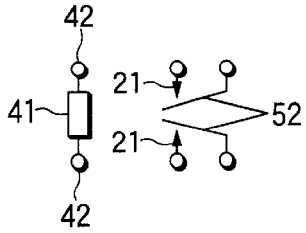
FIG. 8D is an electric circuit diagram of the electromagnetic relay.
Figure 8B:
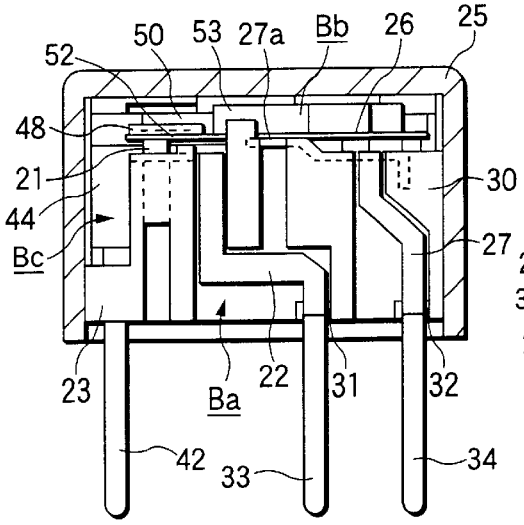
FIG. 8B is a side cross-sectional view of the electromagnetic relay.
Figure 8C:
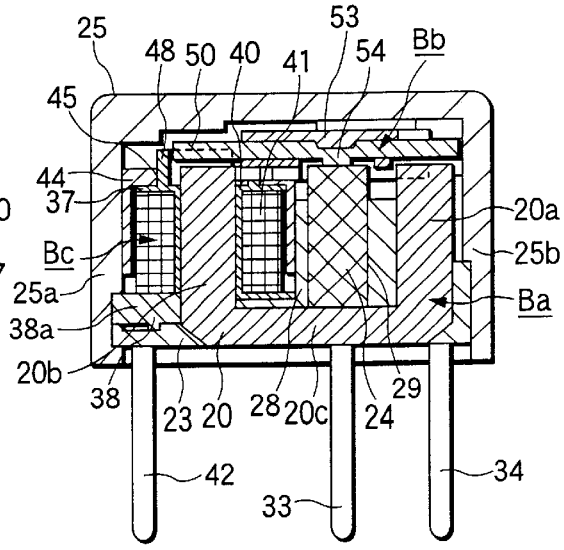
FIG. 8C is a side cross-sectional view of the electromagnetic relay as taken at another location.
Figure 9:
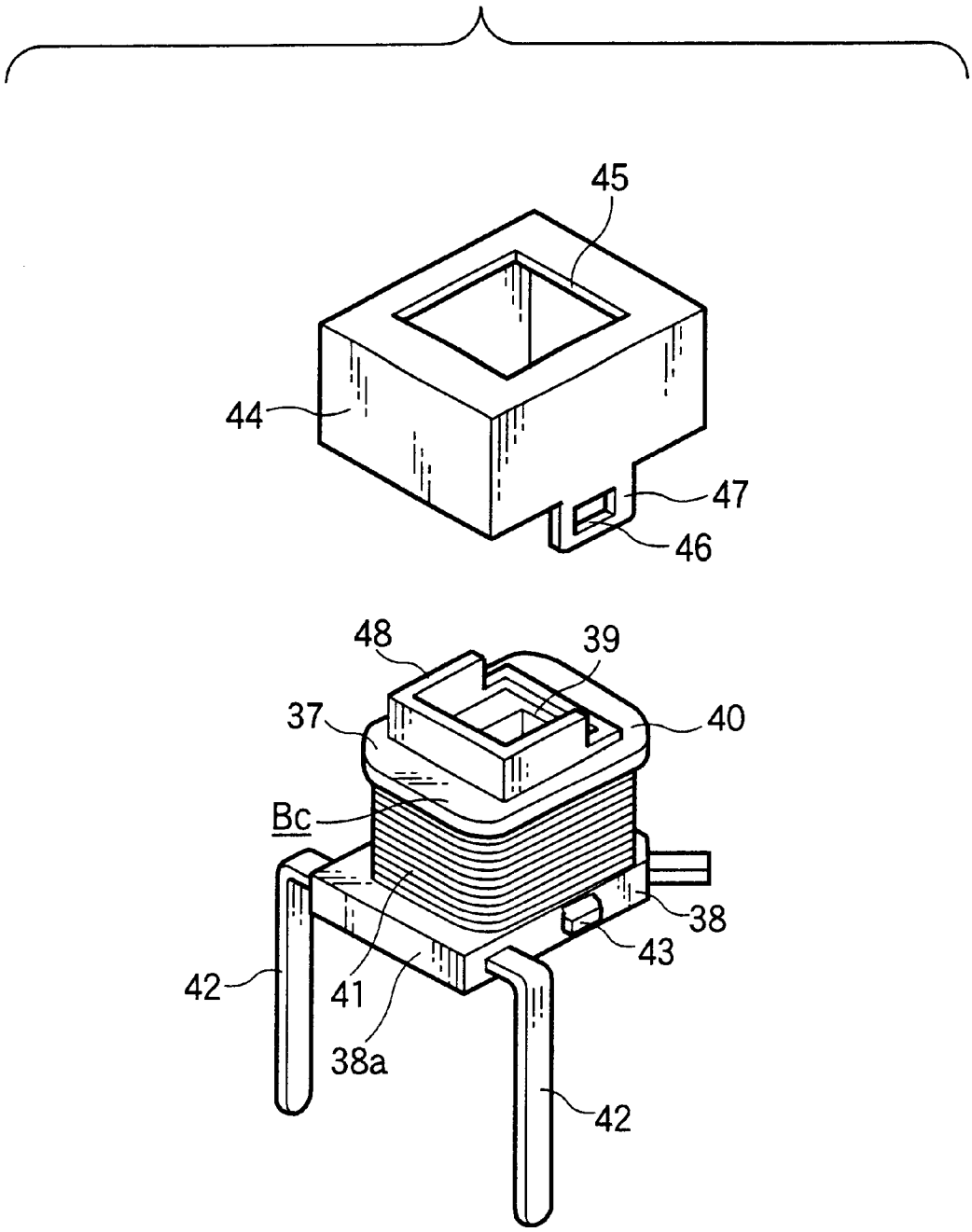
FIG. 9 is an exploded perspective view of a coil block for the electromagnetic relay.

Referring to FIGS. 7 to 9, fourth embodiment will be more particularly described below.

The electromagnetic relay of fourth embodiment, as shown in FIGS. 7 and 8, comprises a body block Ba having a body 23 composed of a synthetic resin molding by insert molding a terminal plate 22 with an iron core 20 and a fixed contact 21, and a terminal plate 27 with a composition plane 27*a* to which one end of a hinge spring 26 provided on an armature block Bb is secured, the armature block Bb, a coil block Bc, and a permanent magnet 24, in which the body block Ba is assembled with the armature block Bb, the coil block Bc and the permanent magnet 24, and a box case 25 made of synthetic resin with an opening on the bottom is attached onto the body block Ba.

The iron core 20 is formed by stumping a magnetic iron plate like a U-shape, and inserted into and secured with the body 23, at molding the body 23, with the pole pieces 20*a,* 20*b* on both sides being protruded from the body 23. An insert position of this iron core 20 is on a line passing through the center of the body 23 in a width direction and shifted from the center of the body 23 in a longitudinal direction. One pole piece 20*a* is closer to one edge side of the body 23, and the other pole piece 20*b* is apart from the other edge of the body 23 and closer to the central side. And a rectangular barrel 28 is protruded integrally on the body 23 along an inner side of one pole piece 20*a*. This rectangular barrel 28 has centrally a hole 29 rectangular elongated in cross section that arranged to an upper face of the central piece 20*c* of the iron core 20 with a bottom portion inserted into the body 23, at a position close to one pole piece 20*a* rather than the central position defined between the pole pieces 20*a,* 20*b* on both sides of the iron core.

The hole 29 has the prismatic permanent magnet 24 substantially identical in cross sectional shape press-fitted or inserted therein from the upward. This permanent magnet 24 is magnetized with different magnetic poles at the upper and lower ends, a pole face at the lower end being attracted onto an upper face of the central piece 20*c* in the iron core 20, and a pole face at the upper end protruding from an upper end face of the prismatic barrel 28, and being substantially flush with the pole faces of the pole piece 20*a,* 20*b* of the iron core 20. This permanent magnet 24 may be premagnetized, but may be incorporated into the body 23, unmagnetized, and then magnetized.

The side walls 30, 30 extend upwardly on both sides of the body 23 in parallel to the iron core 20, the outer side faces of side walls 30 being formed with the grooves 31, 32 for leading the terminals 33, 34 at the top of the terminal plates 22, 27, partially inserted into the side walls 30, to the lower face side of the body 23, respectively. And the fixed contact 21 provided at one end portion of the terminal plate 22 is exposed on the upper face of a portion of the side wall 30 in parallel to the pole piece 20*b,* and a composition plane 27*a* provided at one end portion of the terminal plate 27 is exposed on the upper face of the side wall 30 near the central portion.

At the edge of the body 23 on the side of the pole piece 20*b,* a low partition wall 35 is formed integrally with one end leading to the end face of the side walls 30, 30, and formed with a notch 36 for fitting an end portion 38*a* of a collar 38 for a coil bobbin 37 in the armature block Bb, as will be described later, in the central part of this partition wall 35.

The coil block Bc includes the coil bobbin 37 formed centrally with a central through hole 39 having the substantially same lateral cross section as that of the pole piece 20*b* and passing the pole piece 20*b* therethrough, and a coil 41 wound around a barrel portion between the collar portions 38, 40 on both ends of the coil bobbin 37, the coil terminals 42, 42, to which the coil 41 is connected, protruding from both side faces closer to the end portion 38*a* of the collar 38 at the bottom, as shown in FIG. 9. These coil terminals 42, 42 are bent like an inverse L character and extend downward. The engaging projections 43, 43 for securing an insulating case 44 which is attached on the coil block Bc are integrally formed on both side faces of the collar 38.

Further, an opening of the central through hole 39 for an upper collar portion 40 is surrounded by a rib 48 except for the side to which an end portion of the armature 50 in the armature block Bb is faced. This rib 48 is formed to be higher than the top position of the pole piece 20*b* extending upward from the opening of the central through hole 39.

The insulating case 44 is made of a synthetic resin molding, like a box with an opening on the bottom face. A top end portion of the pole piece 20*b* extends from the central through hole 39 of the coil bobbin 37, and an opening window 45 for protruding the rib 48 outward is provided on a ceiling face of the insulating case 44. At the lower edge of a pair of opposed side walls, a resilient projecting piece 47 having an engagement bore 46 is integrally jutted out, in which a lower end of the engagement bore 46 is laid on the taper face of the engaging projection 43 formed on the side face of the collar portion 38 for the coil bobbin 37, and internally engaged with the engaging projection 43, in attaching the coil block Bc. Due to the engaging projection 43 and the engagement bore 46, the insulating case 44 can be attached onto the coil block Bb by one touch.

By the way, in assembling the coil block Bb having the insulating case 44 attached with the base block Ba, the tip of the pole piece 20*b* is inserted through the bottom opening of the central through hole 39 for the coil bobbin 37, while at the same time the tip of each coil terminal 42 is passed, from above, through a coil terminal bore 49 opened on the upper face on either side of the body 23 near the edge of the side wall 30, 30. Then, the collar portion 38 of the coil bobbin 37 is placed on the body 23, and the end portion 38*a* of the collar portion 38 is fitted into the notch 36 of the partition wall 35, as shown in FIG. 7(*a*). At this time, the end face of the end portion 38*a* is substantially flush with an outside face of the partition wall 35.

The armature block Bb comprises the armature 50 made of a magnetic material, a T-shaped synthetic resin molding 53 having the arms 51, 51 extending in both directions of the armature 50 from an off-centered position shifted from the central position of the armature 50, with the central portion of this armature 50 inserted, the contact springs 52, 52 extending forward from the face of each arm 51 toward the central side of the armature 50, the contact springs 52, 52 being inserted into the respective arms 51 of the synthetic resin molding 53, and the U-shaped hinge springs 26, 26 extending from the rear end of each of the contact springs 52, 52, and projecting backwardly from the face of each arm 51 on the opposite side to the protruding face of each of the contact springs 52.

As shown in FIG. 7(*b*), the hinge springs 26 has a length of one side piece 26*a* extending from the arm 51 slightly shorter than the length of a part of the armature 50 extending in parallel from the synthetic resin molding 53, the other side piece 26*b* bent at a central piece and extending in parallel to the armature 50 being as long as its tip substantially reaching the center of armature 50 in the lengthwise direction.

The tip end of each contact spring 52 is bifurcated, with a moving contact provided on a respective lower face, thereby making a so-called twin contact.

When placed on the iron core 20, the armature 50 has a size in the lengthwise direction slightly greater than the size of the iron core 20 in the lengthwise direction, so that the lower faces on both ends of the armature 50 can be opposed to the pole faces of the pole pieces 20*a*, 20*b*, and has a projection 54 formed at an off-centered position on a lower face of the armature 50 that is opposed to an upper end face of the permanent magnet 24 fitted between the pole pieces 50*a*, 50*b*, this projection 54 being laid freely in seesaw motion on the upper end face of the permanent magnet 24 to act as a fulcrum of the seesaw motion.

The armature block Bb constituted in the above way is incorporated into the base block Ba after the coil block Bc is incorporated in the above way, in which the projection 54 is laid on the upper end face of the permanent magnet 24, and the tip of an outside piece of the hinge spring 26, 26 on either side is welded onto the composition plane 27*a* of the terminal plate 27 exposed on a substantially central upper face of the side walls 30, 30.

Thereby, the moving contact on the lower face at the tip of each contact spring 52, 52 is disposed opposite the respective fixed contact 21, and the lower face on either end of the armature 50 is disposed opposite the pole face of the pole piece 20*a*, 20*b* in the iron core 20.

In this way, if the case 25 is attached on the body block Ba, after incorporating the coil block Bc and the armature block Bb to the body block Ba, a 2*a* type electromagnetic relay as shown in FIG. 8(*d*) can be obtained. If the case 25 is attached on the body block Ba, a down step 25*a* that is a projection provided on an inner wall face on the side of the coil block Bc carries an end portion 38*a* of the collar portion 38 in the coil bobbin 37 with the body 23, as shown in FIG. 8C, so that the coil block Bc containing the coil bobbin 37 can be fixedly secured to the body block Ba. Also, a down step 25*b* is provided on an inner wall face of the case 25 on the side of the pole piece 20*a*, and is laid on an upper face of the body 23 near an exposed base portion of the pole piece 20*a*.

Figure 36A:
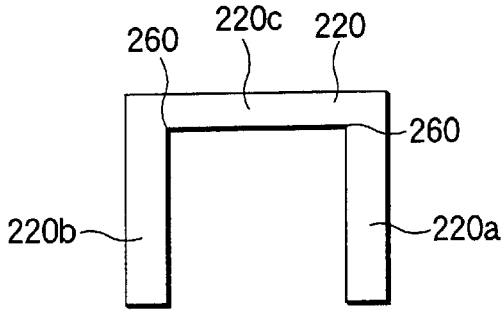
FIGS. 36(*a*) to (*c*) are explanatory views of insert molding an iron core and a body in the electromagnetic relay.
Figure 36B:
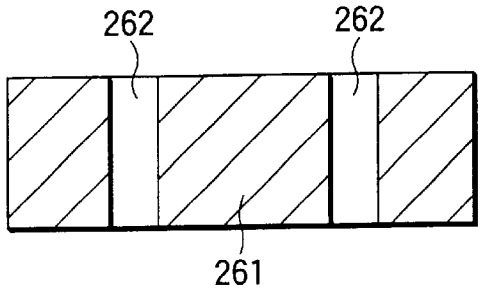
Figure 36C:
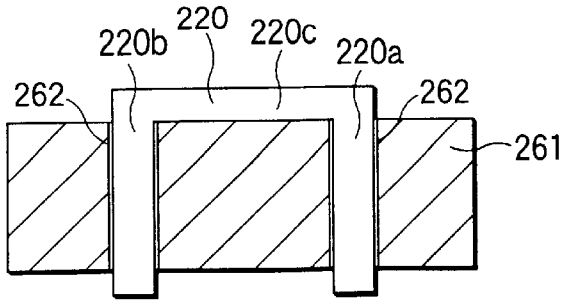

By the way, in this embodiment, the iron core 220 is formed by stamping as described above. A corner portion 260 formed on the base portion between the pole piece 220*a*, 220*b* and the central piece 220*c* has a high accuracy, as shown in FIG. 36(*a*). Accordingly, when the iron core 220 is embedded in the body 223 by insert molding, the holes 262, 262 for inserting the pole pieces 220*a*, 220*b* are formed in a metal mold 261, as shown in FIG. 36(*b*). In molding, the pole pieces 220*a*, 220*b* are inserted to effect insert molding, as shown in FIG. 36(*c*).

Figure 37A:
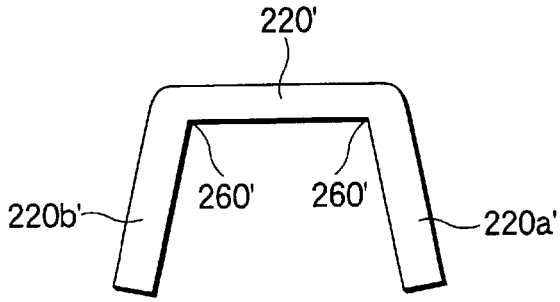
FIGS. 37(*a*) to (*c*) are explanatory views of insert molding an iron core and a body in a comparative example of the electromagnetic relay.
Figure 37B:
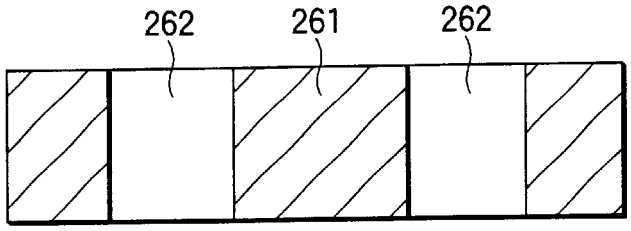
Figure 37C:
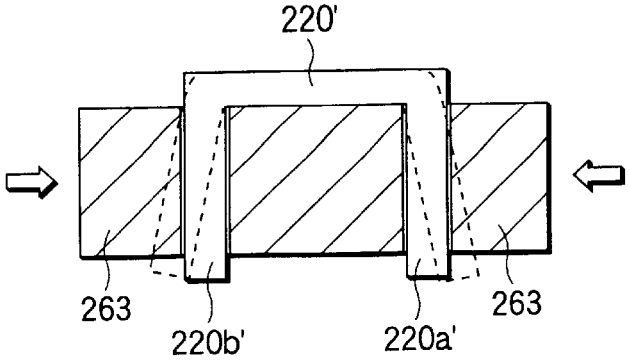

Namely, in the case where the iron core 220' is formed by bending as shown in FIG. 37(*a*), the accuracy of the corner portion 260' is not superior that the pole pieces 220*a'*, 220*b'*, are opened. Due to this opened state, when the holes 262, 262 for inserting the pole pieces 220*a'*, 220*b'* into the metal mold 261 are provided, as shown in FIG. 37(*b*), the opened state must be considered. When such metal mold 61 is employed, the resin enters the holes 262, 262, resulting in less accuracy molding. Accordingly, when the iron core 220' formed by bending is subjected to insert molding, the pole pieces 220*a'*, 220*b'* are compulsorily pressed to modify the opened state, in clamping the slide cores 263, 263, and then the iron core is subjected to insert molding, as shown in FIG. 37(*c*). Therefore, the slide cores 263, 263 are required, and in the case where the body block is formed by insert molding, a number of iron cores can not be molded at a time. On the contrary, when employing the iron core 20 formed by stamping or casting as in this embodiment, there is no need of providing the slide cores, a number of iron cores can be molded at one time. The iron core 20 may be the cast iron core or the sintered iron core, besides the punched iron core, to attain the same merits in molding as in this embodiment.

Thus, the electromagnetic relay of this embodiment has amend portion closer to a fulcrum position of the armature 50 attracted and held on a pole face of the pole piece 20*a*, in normal state, due to a spring urging force of the hinge spring 26, 26 and a magnetic force of the permanent magnet 24, the moving contact of the contact spring 52, 52 being left away from the fixed contact 21. In this case, a closed magnetic path is made up of the permanent magnet 24, the armature 50, and the iron core 20 containing the pole piece 20*a*, to keep the armature 50 in an operation state.

In this states if an exciting current is passed through the coil 41 via the coil terminals 42, 42 in a direction of canceling a magnetic force of the permanent magnet 24 on the side of the pole piece 20*a* of the iron core 20, so that a attraction force exceeding a spring load of the hinge spring 26, 26, along with the magnetic force of the permanent magnet 24, is generated on the side of the pole piece 20*b*, the armature 50 is moved in seesaw motion in a counterclockwise direction around a fulcrum of the projection 54 as shown in FIG. 8C, enabling the end parts of the contact springs 52, 52 to be attracted onto the pole face of the pole piece 20*b*. At this time, the moving contact at the tip of the contact spring 52, 52 is resiliently touched on the fixed contact 21, 21 to turn on the terminals 33, 34 of the terminal plates 22, 27. This state can be held by passing an exciting current continuously. FIGS. 8B and 8C show the intermediate state of operation.

And if the exciting current is turned off, the armature 50 is rotated around the fulcrum of the projection 54 in a clockwise direction, because the return force of the hinge springs 26, 26 and the contact springs 52, 52 is greater than the attraction force of the permanent magnet 24 on the side of the pole piece 20*b*. Further, a attraction force due to a magnetic force of the permanent magnet 24 that occurs on the side of the pole piece 20*a* is additionally applied, so that the above normal state is restored. Thereby, the moving contact of the contact spring 52, 52 is left away from the fixed contact 21, 21 and placed in an off state. Herein, in the case where the return force due to a spring urging force is smaller than the attraction force due to a magnetic force of the permanent magnet 24, the operation state of the armature 50 can be kept due to the magnetic force of the permanent magnet 24, even if the exciting current is turned off. Accordingly, in the case where a contact off state is restored, an exciting current is passed through the coil 41 in a direction of canceling the magnetic force of the permanent magnet 24.

In this embodiment 4, whether the electromagnetic relay is a self-holding type or a type of keeping the on state by passing an exciting current can be selected by setting appropriately the spring load.

Figure 38:
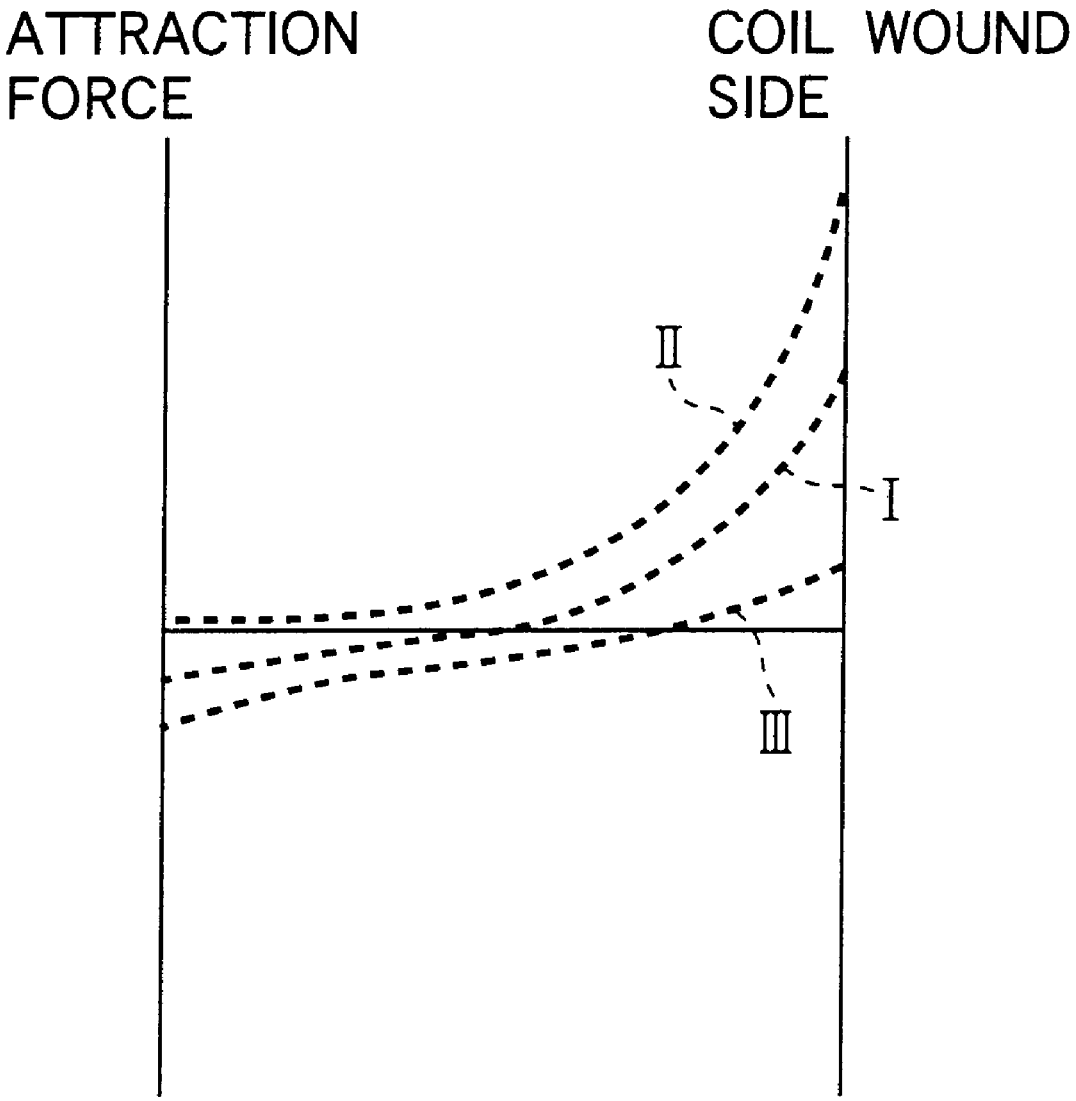
FIG. 38 is a suction force characteristic diagram of the electromagnetic relay of the fourth embodiment.

FIG. 38 shows the attraction force characteristics of this embodiment. A curve (I) shows the attraction force characteristic at the time of no excitation, a curve (II) the attraction force characteristic at the time of attraction operation, and a curve (III) the suction characteristic at the time of return operation.

By the way, when the contact is opened or closed in the above manner, the wear powder of contact material is produced over a contact region, or the wear powder is produced from the pole piece 20*a*, 20*b* of the iron core 20 onto which the armature 40 is attracted. However, the rib 48 of the coil bobbin 37 prevents the wear powder from scattering, and prevents the wear powder from moving to the pole face of the pole piece 20*a*, 20*b*. Further, the insulation is secured by increasing the insulation distance between the coil 41 and the pole piece 20*b* of the iron core 20.

In the above embodiment 4, the permanent magnet 24 is inserted into the hole 29 of the prismatic barrel portion 28, but may be integrated with the body 23 by insert molding, like the iron core 20. In this case, a step of incorporating the permanent magnet 24 into the body block Ba can be omitted, and the basic size between the pole face of the pole piece 20*a*, 20*b* and the fixed contact 21 as well as the basic size between the pole faces and the permanent magnet 24 can be obtained at high precision, so that the armature 50 can be stabilized in stroke.

Also, in this embodiment 4, when the spring is adjusted, the central piece of the hinge spring 26 may be shifted by a jig.

Fifth Embodiment

Figure 10:
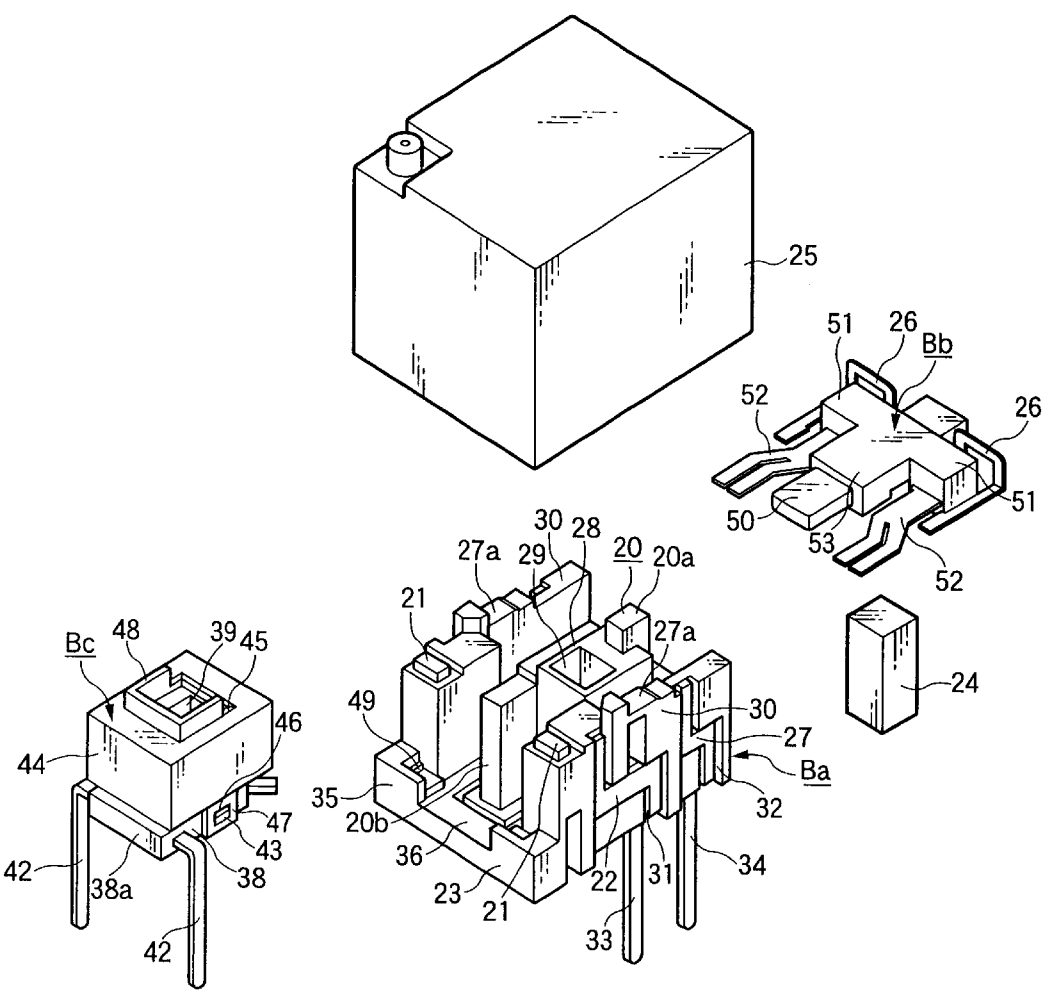
FIG. 10 is an exploded perspective view of an electromagnetic relay according to an fifth embodiment of the invention.

A fifth embodiment is basically the same as the fourth embodiment, except that the central piece of the hinge spring 26 is bent perpendicularly to a plate face of the side piece, whereby the spring adjustment can be made by picking up the central piece from upward at the time of adjustment, and shifting forth or back the central piece with respect to the plate face, as shown in FIG. 10. Other parts are the same as those of FIG. 7, therefore designated by the same reference numerals, and not described.

Sixth Embodiment

Figure 11:
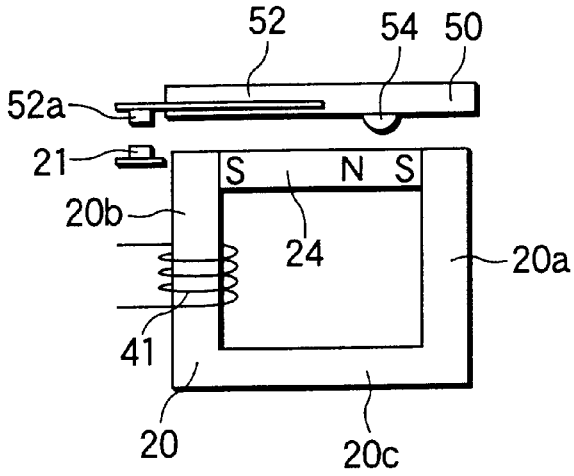
FIG. 11 is a schematic view of an electromagnetic relay according to a sixth embodiment of the invention.

In the above fourth and fifth embodiments, the permanent magnet 24 is erected vertically. However, in this embodiment, the permanent magnet 24 is magnetized at both ends to the same magnetic pole, with an off-center position magnetized to a different magnetic pole, and the permanent magnet 24 is bridged to make both ends contact with the inner side faces at the tip of the pole pieces 20*a*, 20*b* on both sides of the iron core 20, the fulcrum of the armature 50 being placed at an off-centered pole position, as shown in FIG. 11.

Seventh Embodiment

Figure 12:
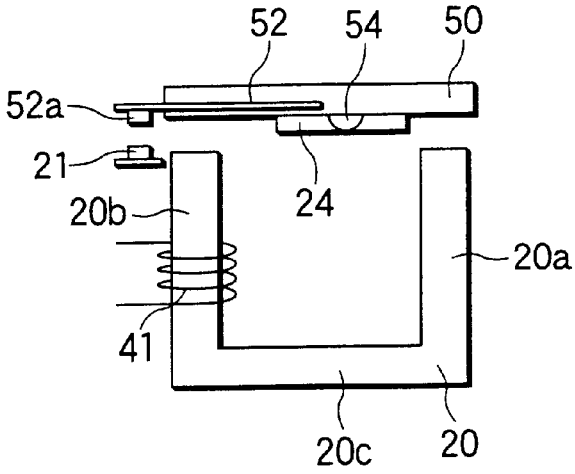
FIG. 12 is a schematic view of an electromagnetic relay according to an seventh embodiment of the invention.

In the seventh embodiment, the permanent magnet 24 is provided on the side of the armature 50, and the center position of the permanent magnet 24 is shifted in accordance with the position of fulcrum, as shown in FIG. 12.

In the above embodiments, both the electromagnet driving apparatus and the electromagnetic relay are provided with one coil 41, but the coil may be wounded on each of the pole pieces 20*a*, 20*b* of the iron core 20. In this case, the attraction force on both sides of the fulcrum of the armature 50 can be broadened in width.

Eighth Embodiment

Figure 13:
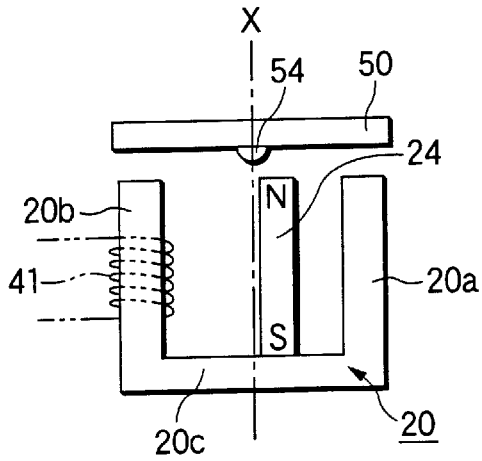
FIG. 13 is a schematic view, partially omitted, of an electromagnet driving apparatus according to an eighth embodiment of the invention.

In the first embodiment, the position of the permanent magnet 24 is made coincident with the position of the fulcrum 54 of the armature 50. However, in eighth embodiment, the fulcrum 54 of the armature 50 is disposed on the central line X between the pole pieces 20*a*, 20*a* of the iron core 20, as shown in FIG. 13. When one coil is wounded around the iron core 20, the position of the coil 41 may be on a pole piece 20*b* with a free space or a lateral piece 20*c* between the pole piece 20*b* and the permanent magnet 24 as shown in the figure.

Figure 14:
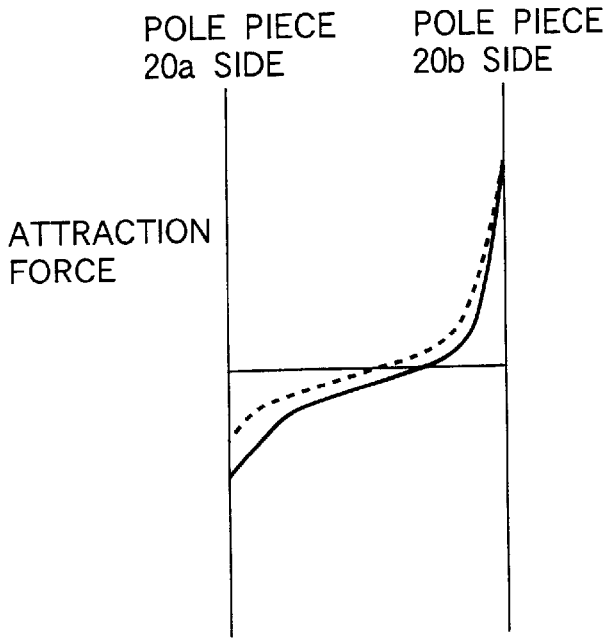
FIG. 14 is an explanatory diagram of the attraction force characteristic for the electromagnetic relay.

With the constitution of this embodiment 8, a attraction force curve is obtained, as indicated by the solid line in FIG. 14. In FIG. 13, the attraction force on the side of the pole piece 20*b* (where the coil is wounded) is the same as in the first embodiment, but the attraction force on the side of a pole piece 20*a* can be greater than that in the first embodiment (as indicated by the broken line). That is, an electromagnetic relay as shown in FIG. 6 can be constituted in this embodiment, employing a magnetic circuit having the unbalanced attraction characteristic in which the attraction force on the normally open side (pole piece 20*b*) is unchanged, and the attraction force on the normally closed side (pole piece 20*a*) is increased, the magnetic circuit being easily matched with the asymmetrical spring load.

Ninth Embodiment

In this embodiment, the permanent magnet 24 is arranged with the same structure as in the embodiment 2, and the attraction force is increased as in the eighth embodiment.

Figure 15:
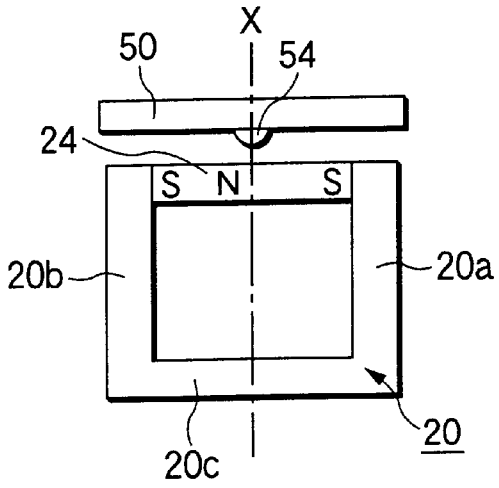
FIG. 15 is a schematic view, partially omitted, of an electromagnet driving apparatus according to a ninth embodiment of the invention.

That is, the permanent magnet 24 has both ends magnetized at the same magnetic pole (S pole in the figure), and an intermediate part off the center between both ends magnetized to a different magnetic pole (N pole), as shown in FIG. 15. The permanent magnet 24 is bridged to make both ends contact with the inner side faces at the tip of the pole pieces

20*a,* 20*b* on both sides of the iron core 20, and the fulcrum 54 of the armature 50 is disposed on the central line X between the pole pieces 20*a,* 20*b* on both sides of the iron core 20. When one coil is wounded around the iron core 20, it may be attached on the pole piece 20*b* or the lateral piece 20*c*.

Thus, in the ninth embodiment, a similar attraction curve to that of the eight embodiment can be obtained in this embodiment, employing the contact structure as shown in FIG. 6, an electromagnetic relay can be realized with a magnetic circuit having the unbalanced attraction characteristic in which the attraction force on the normally open side (pole piece 20*b*) is unchanged, and the attraction force on the normally closed side (pole piece 20*a*) is increased, the magnetic circuit being easily matched with the asymmetrical spring load.

Tenth Embodiment

Tenth embodiment has a structure with the permanent magnet 24 attached to the armature 50, like the third embodiment, in which the attraction force is increased as in the eighth embodiment.

Figure 16:
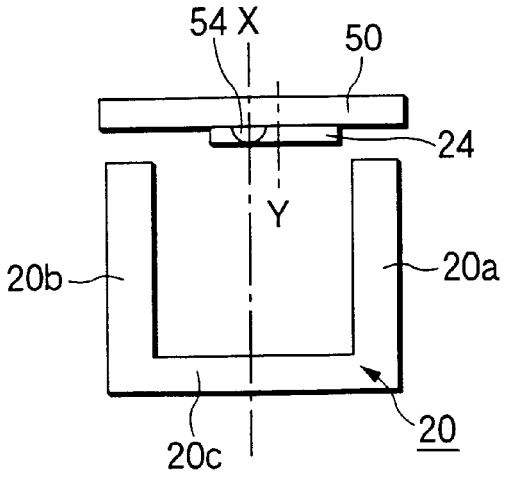
FIG. 16 is a schematic view, partially omitted, of an electromagnet driving apparatus according to an tenth embodiment of the invention.

Namely, as shown in FIG. 16, the permanent magnet 24 is magnetized at both ends to different magnetic poles. This permanent magnet 24 is attached to the armature 50, so that the lengthwise direction of the permanent magnet 24 may be parallel to the lengthwise direction of the armature, with the central position Y of the permanent 24 being shifted from a position on the central line X between the pole pieces 20*a,* 20*b* at both ends of the iron core 20, and the fulcrum 54 of the armature 50 is disposed on the central line X between the pole pieces 20*a,* 20*b* at both ends of the iron core 20. When one coil is wounded around the iron core 20, it may be attached on the pole piece 20*b* or the lateral piece 20*c*.

Thus, in tenth embodiment, a similar attraction curve to that of the ninth embodiment can be obtained. In this case, employing the contact structure as shown in FIG. 6, an electromagnetic relay can be realized with a magnetic circuit having the unbalanced attraction force characteristics in which the attraction force on the normally open side (pole piece 20*b*) is unchanged, and the attraction force on the normally closed side (pole piece 20*a*) is increased, the magnetic circuit being able to be easily matched with the asymmetrical spring load.

Eleventh Embodiment

Figure 17:
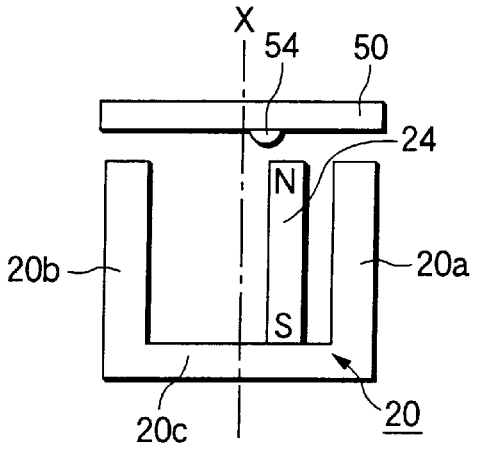
FIG. 17 is a schematic view, partially omitted, of an electromagnet driving apparatus according to an eleventh embodiment of the invention.

In the eighth embodiment, the fulcrum 54 of the armature 50 is disposed on the central line X between the pole pieces 20*a,* 20*b* of the iron core 20. However, in the eleventh embodiment, the position of the fulcrum 54 is on the side of the permanent magnet 24 off the central line X, and closer to the central line X than the position of the permanent magnet 24, as shown in FIG. 17.

Figure 18:
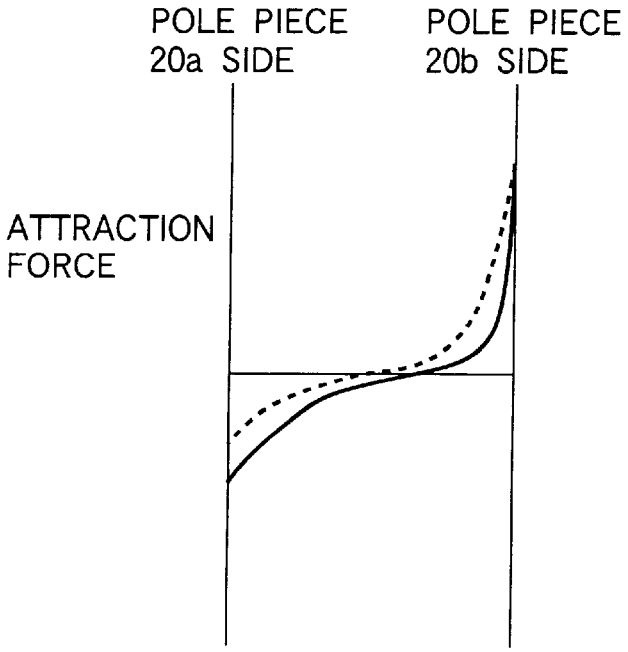
FIG. 18 is an explanatory diagram of the attraction force characteristic for the electromagnetic relay.

Namely, in the eighth embodiment, the magnetic circuit is constructed so that the attraction force on the side of the pole piece 20*a* is greater than in the first embodiment. However, in the eleventh embodiment, the attraction force on the side of the pole piece 20*b* (where the coil is wounded) is smaller than in the first embodiment (as indicated by the broken line), as indicated by the solid line in FIG. 18, and the attraction force on the side of the pole piece 20*a* is further increased.

In this embodiment, employing the contact structure as shown in FIG. 6, an electromagnetic relay can be realized with a magnetic circuit having the unbalanced attraction characteristic in which the attraction force on the normally open side (pole piece 20*b*) is reduced, and the attraction force on the normally closed side (pole piece 20*a*) is increased, the magnetic circuit being easily matched with the asymmetrical spring load in the design of the electromagnetic relay of single type (current holding type) in particular.

Twelfth Embodiment

Figure 19:
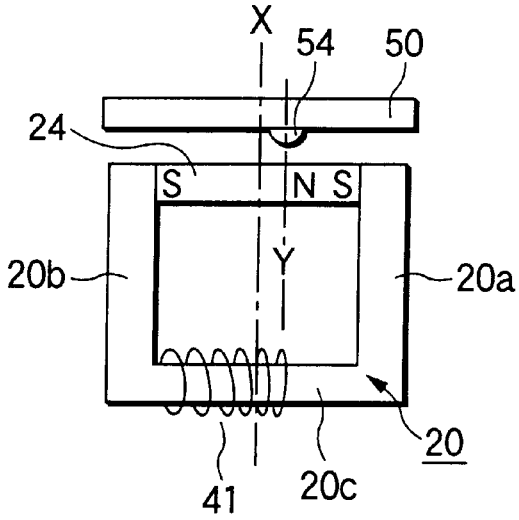
FIG. 19 is a schematic view, partially omitted, of an electromagnet driving apparatus according to an twelfth embodiment of the invention.

In the ninth embodiment, the fulcrum 54 of the armature 50 is disposed on the central line x between the pole pieces 20*a,* 20*b* of the iron core 20. However, in the twelfth embodiment, the central line Y of the fulcrum 54 is on the side of a magnetized position (N pole) in the intermediate part of the permanent magnet 24 off the central line X, and closer to the central line X than the magnetized position, as shown in FIG. 19. A coil 41 wound around the iron core 20 on a position defined from a corresponding fulcrum position of the armature to at least a proximal end of one pole piece 20*a* arranged far from the position corresponding to the fulcrum position.

Namely, in the ninth embodiment, the magnetic circuit is constituted so that the attraction force on the side of the pole piece 20*a* may be greater than in the first embodiment. However, in the twelfth embodiment, as like eleventh the embodiment, the attraction force on the side of the pole piece 20*b* is smaller than in the first embodiment, and the attraction force on the side of the pole piece 20*a* is further increased.

In this embodiment, employing the contact structure as shown in FIG. 6, an electromagnetic relay can be realized with a magnetic circuit having the unbalanced attraction characteristic in which the attraction force on the normally open side (pole piece 20*b*) is reduced, and the attraction force on the normally closed side (pole piece 20*a*) is increased, whereby the magnetic circuit can be easily matched with the asymmetrical spring load in the design of the electromagnetic relay of single type (current holding type) in particular.

Thirteenth Embodiment

Figure 20:
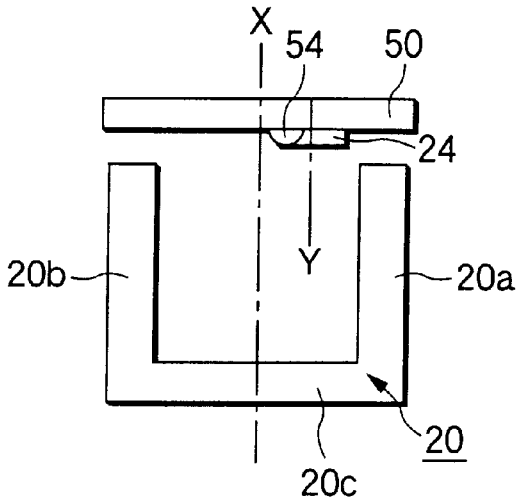
FIG. 20 is a schematic view, partially omitted, of an electromagnet driving apparatus according to a tenth embodiment of the invention.

In the tenth embodiment, the fulcrum 54 of the armature 50 is disposed on the central line X between the pole pieces 20*a,* 20*b* of the iron core 20. However, in the thirteenth embodiment, the position of the fulcrum 54 is on the side of the central position Y of the permanent magnet 24 off the central line X, and closer to the central line X than the central position Y of the permanent magnet 24, as shown in FIG. 20.

Namely, in the tenth embodiment, the magnetic circuit is constructed so that the attraction force on the side of the pole piece 20*a* is greater than in the first embodiment. However, in the thirteenth embodiment 13, like the eleventh embodiment, the attraction force on the side of the pole piece 20*b* is smaller than in the first embodiment, and the attraction force on the side of the pole piece 20*a* is further increased.

In this embodiment, employing the contact structure as shown in FIG. 6, an electromagnetic relay can be realized with a magnetic circuit having the unbalanced attraction characteristic in which the attraction force on the normally open side (pole piece 20*b*) is reduced, and the attraction force on the normally closed side (pole piece 20*a*) is increased, whereby the magnetic circuit can be easily matched with the asymmetrical spring load in the design of the electromagnetic relay of single type (current holding type) in particular.

Fourteenth Embodiment

Figure 21:
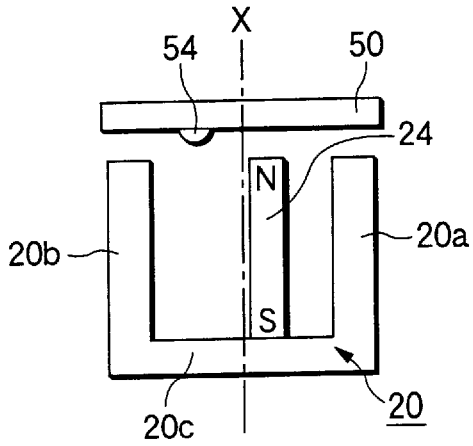
FIG. 21 is a schematic view, partially omitted, of an electromagnet driving apparatus according to an fourteenth embodiment of the invention.

In the eleventh embodiment, the fulcrum 54 of the armature 50 is shifted toward the position of the permanent magnet 24. However, in this embodiment 14, the position of the fulcrum 54 is shifted to the opposite side of the permanent magnet 24 off the central line X between the pole pieces 20*a,* 20*b* of the iron core 20, as shown in FIG. 21.

Figure 22:
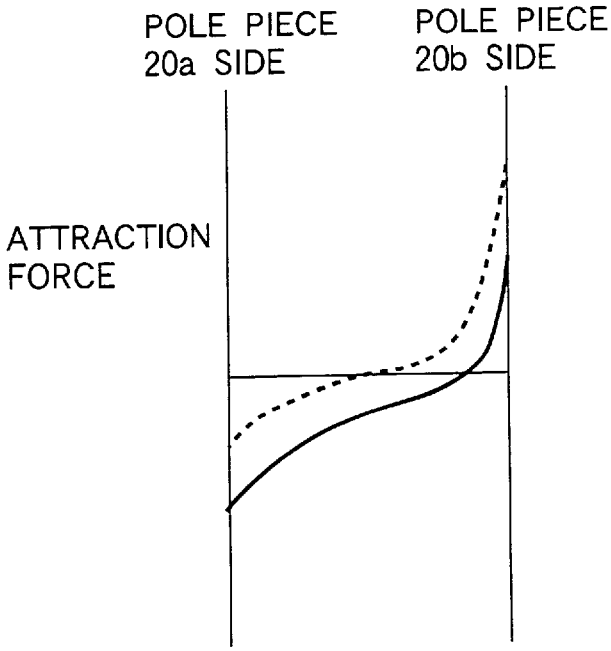
FIG. 22 is an explanatory diagram of the attraction force characteristic for the electromagnet driving apparatus shown in FIG. 21.

Namely, in the fourteenth embodiment, the attraction characteristic as indicated by the solid line in FIG. 22 is more unbalanced than in the first embodiment (as indicated by the broken line).

In this embodiment, employing the contact structure as shown in FIG. 6, an electromagnetic relay can be realized with a magnetic circuit having the unbalanced attraction characteristic in which the attraction force on the normally open side (pole piece 20*b*) is further reduced, and the attraction force on the normally closed side (pole piece 20*a*) is further increased, whereby the magnetic circuit can be easily matched with the asymmetrical spring load in the design of the electromagnetic relay of single type (current holding type) in particular.

Fifteenth Embodiment

Figure 23:
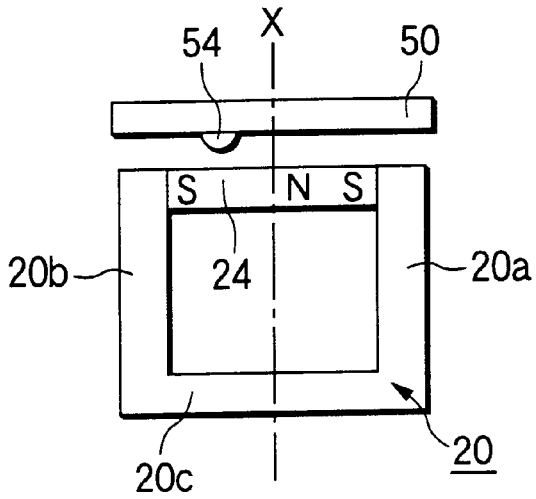
FIG. 23 is a schematic view, partially omitted, of an electromagnet driving apparatus according to a fifteenth embodiment of the invention.

In the twelfth embodiment, the fulcrum 54 of the armature 50 is shifted toward the magnetic pole (N pole) in the intermediate part of the permanent magnet 24. However, in the fifteenth embodiment, the position of the fulcrum 54 is shifted to the opposite side of the magnetized position in the intermediate part of the permanent magnet 24 off the central line X between the pole pieces 20*a,* 20*b* of the iron core 20, as shown in FIG. 23.

Namely, in the fifteenth embodiment, the attraction force on the side of the pole piece 20*a* is greater than in the twelfth embodiment, and like the fourteenth embodiment, the attraction force characteristic is more unbalanced than in the twelfth embodiment.

In this embodiment, employing the contact structure as shown in FIG. 6, an electromagnetic relay can be realized with a magnetic circuit having the unbalanced attraction characteristic in which the attraction force on the normally open side (pole piece 20*b*) is further reduced, and the attraction force on the normally closed side (pole piece 20*a*) is further increased, whereby the magnetic circuit can be easily matched with the asymmetrical spring load in the design of the electromagnetic relay of single type (current holding type) in particular.

Sixteenth Embodiment

Figure 24:
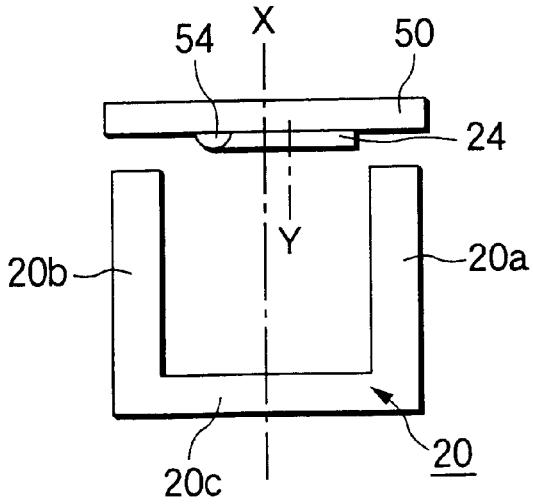
FIG. 24 is a schematic view, partially omitted, of an electromagnet driving apparatus according to a sixteenth embodiment of the invention.

In the sixteenth embodiment, the fulcrum 54 of the armature 50 is shifted toward the central position Y of the permanent magnet 24. However, in the sixteenth embodiment, the position of the fulcrum 54 is shifted to the opposite side of the central position Y of the permanent magnet 24 off the central line X between the pole pieces 20*a,* 20*b* of the iron core 20, as shown in FIG. 24.

Namely, in the sixteenth embodiment, like the fourteenth embodiment, the attraction force characteristic is more unbalanced than in the twelfth embodiment.

In this embodiment, employing the contact structure as shown in FIG. 6, an electromagnetic relay can be realized with a magnetic circuit having the unbalanced attraction characteristic in which the attraction force on the normally open side (pole piece 20*b*) is further reduced, and the attraction force on the normally closed side (pole piece 20*a*) is further increased, whereby the magnetic circuit can be easily matched with the asymmetrical spring load in the design of the electromagnetic relay of single type (current holding type) in particular.

Seventeenth Embodiment

Figure 25B:
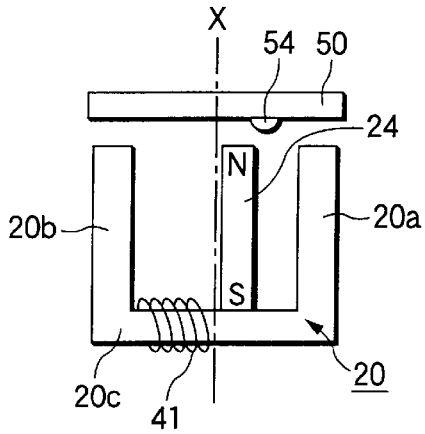
FIG. 25(*a*) is a schematic view, partially omitted, of an example of an electromagnet driving apparatus according to a seventeenth embodiment of the invention.
Figure 25A:
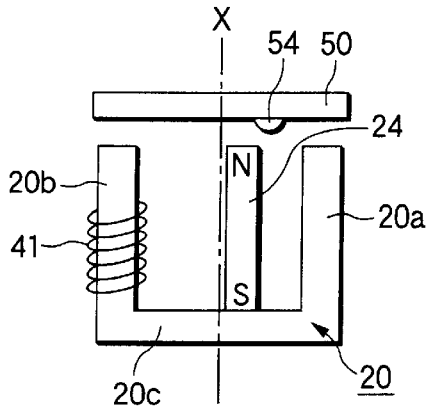

In the eleventh embodiment, the fulcrum 54 of the armature 50 is disposed between the shifted position of the permanent magnet 24, and the central line X between the pole pieces 20*a,* 20*b* on both sides of the iron core 20. However, in the seventeenth embodiment 17, the position of the permanent magnet 24 is shifted closer to the central line X, and the fulcrum 54 of the armature 50 is disposed between the position of this permanent magnet 24 and the pole piece 20*a* of the iron core 20 that is closer to the permanent magnet 24, as shown in FIGS. 25(*a*) and 25(*b*). The attraction force characteristic can be unbalanced, as in the embodiment 11. A large space for winding the coil 41 can be secured by shifting the permanent magnet 24, and the coil 41 may be wounded on the pole piece 20*b* of the iron core 20 or the lateral piece 20*c* between the pole piece 20*b* and the position of the permanent magnet 24, as shown in FIG. 25A. In any example as shown in FIGS. 25(*a*) and 25(*b*), the contact structure as shown in FIG. 6 can be adopted to constitute the electromagnetic relay.

Eighteenth Embodiment

Figure 26B:
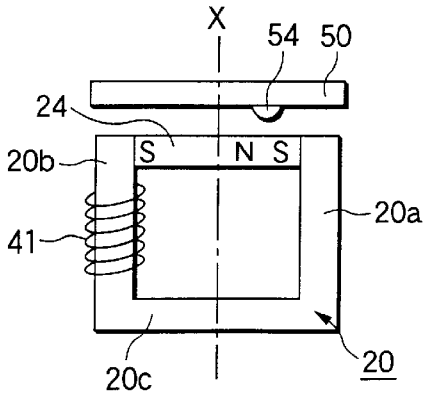
FIG. 26(*a*) is a schematic view, partially omitted, of an example of an electromagnet driving apparatus according to an eighteenth embodiment of the invention.
Figure 26A:
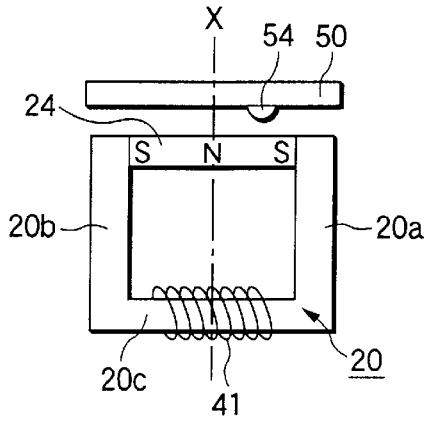

In this twelfth embodiment, the fulcrum 54 of the armature 50 is disposed between the magnetized position off the center in the intermediate part of the permanent magnet and the central line X between the pole pieces 20*a,* 20*b* on both sides of the iron core 20. However, in the eighteenth embodiment, the permanent magnet has the magnetized position in the intermediate part at the center where the central line X passes, and the fulcrum 54 is disposed between the central line X and the pole piece 20*a,* as shown in FIG. 26(*a*). The attraction force characteristic can be unbalanced, as in the twelfth embodiment. In this case, the coil 41 may be attached on the lateral piece 20*c* of the iron core 20.

In the case where the magnetized position in the intermediate part of the permanent magnet 24 is slightly shifted to the fulcrum 54, the coil 41 may be attached to the pole piece 20*a* of the iron core 20, as shown in FIG. 26(*b*). In any example as shown in FIGS. 26(*a*) and 26(*b*), the contact structure as shown in FIG. 6 can be adopted to constitute the electromagnetic relay.

Nineteenth Embodiment

Figure 27B:
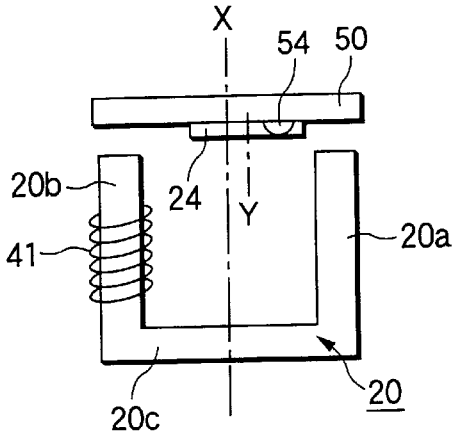
FIG. 27(*a*) is a schematic view, partially omitted, of an example of an electromagnet driving apparatus according to an nineteenth embodiment of the invention.
Figure 27A:
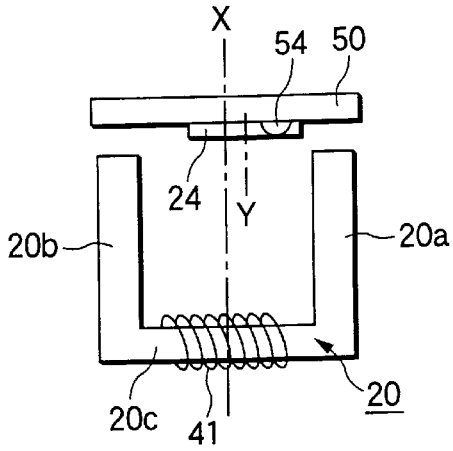

In the thirteenth embodiment, the central position Y of the permanent magnet 24 that is attached integrally to the armature 50 is shifted to the side of the pole piece 20*a* off the central line X passing between the pole pieces 20*a,* 20*b* on both sides of the iron core 20, and the fulcrum 54 of the armature 50 is shifted between the central line X and the central position Y. However, in this embodiment 19, the position of the fulcrum 54 of the armature 50 is shifted between the central position Y and the pole piece 20*a,* so that the attraction force characteristic is unbalanced, as shown in FIGS. 27(*a*) and 27(*b*). The coil 41 may be attached on the lateral piece 20*c* of the iron core 20, as shown in FIG. 27(*a*), or the pole piece 20*a* of the iron core 20, as shown in FIG. 27(*b*).

In any example as shown in FIGS. 27(*a*) and 27(*b*), the contact structure as shown in FIG. 6 can be adopted to constitute the electromagnetic relay.

Twentieth Embodiment

Figure 28B:
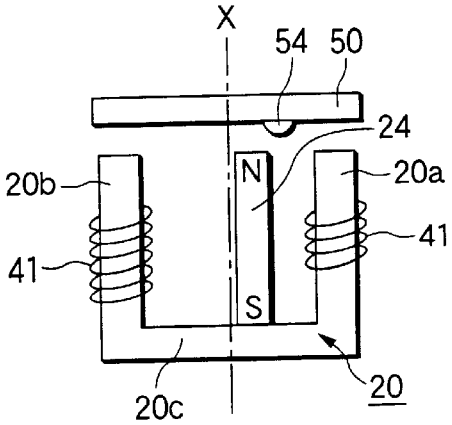
FIG. 28(*a*) is a schematic view, partially omitted, of an example of an electromagnet driving apparatus according to a twentieth embodiment of the invention.
Figure 28A:
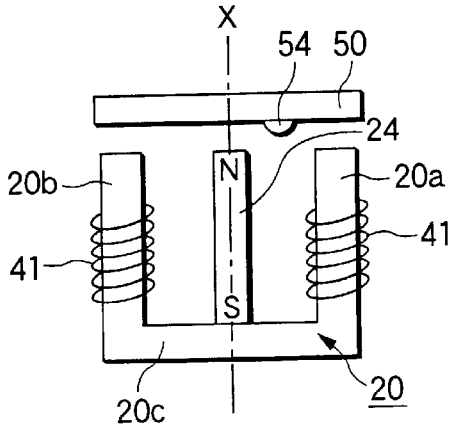

In an electromagnet driving apparatus of the structure in which the permanent magnet 24 is erected on the lateral piece 20*c* of the iron core 20, when the coils having the same characteristic are wounded around the pole pieces 20*a,* 20*b* on both sides of the iron core 20, the permanent magnet 24 is erected at the central position of the lateral piece 20*c* of the iron core 20, or on the central line Y, and the fulcrum 54 of the armature 50 is shifted between the central line Y and the pole piece 20*a,* as shown in FIG. 28(*a*). Namely, the fulcrum 54 is off-centered while making effective use of the arrangement space, so that the attraction force characteristic is unbalanced.

In the case where the position of the permanent magnet 24 is shifted in the same manner as shown in FIG. 25A, a coil 41 wounded around the pole piece 20*a* has a smaller number of turns, and a coil 41 wounded around the pole piece 20*b* has a greater number of turns, so that the characteristics of the left and right coils 41, 41 may be asymmetrical to effect an unbalanced attraction force characteristic, as shown in FIG. 28(*a*).

In any example as shown in FIGS. 28(*a*) and 28(*b*), the contact structure as shown in FIG. 6 can be adopted to constitute the electromagnetic relay.

Twenty-first Embodiment

In the twenty-first embodiment, a coil is wounded around each of the pole pieces 20*a,* 20*b* in the constitution as shown in FIGS. 26(*a*) and 26(*b*). In the case of FIG. 26(*a*) where the permanent magnet 24 is employed with the magnetized position in the intermediate part being the central position, the coils 41, 41 with the same characteristic wounded around the pole pieces 20*a,* 20*b* are employed, as shown in FIG. 29(*a*).

Figure 29B:
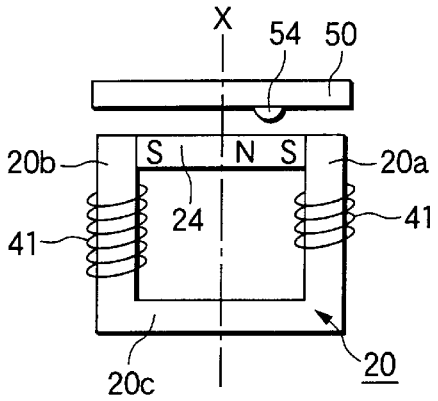
FIG. 29(*a*) is a schematic view, partially omitted, of an example of an electromagnet driving apparatus according to a twentieth-first embodiment of the invention.
Figure 29A:
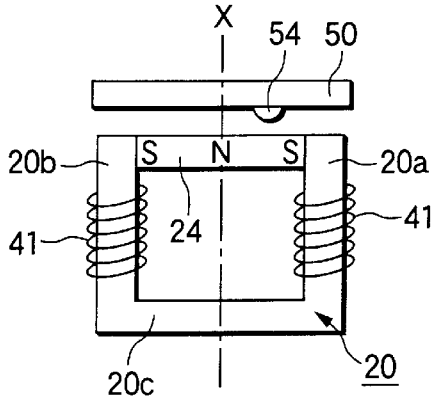

In the case of FIG. 26(*b*) where the permanent magnet 24 with the magnetized position in the intermediate part being shifted off the central position is employed, a coil 41 wounded around the pole piece 20*a* has a smaller number of turns, and a coil 41 wounded around the pole piece 20*b* has a greater number of turns, so that the characteristics of the left and right coils 41, 41 may be asymmetrical to effect an unbalanced attraction force characteristic, as shown in FIG. 29(*b*).

In any example as shown in FIGS. 29(*a*) and 29(*b*), the contact structure as shown in FIG. 6 can be adopted to constitute the electromagnetic relay.

Twenty-second Embodiment

Figure 30B:
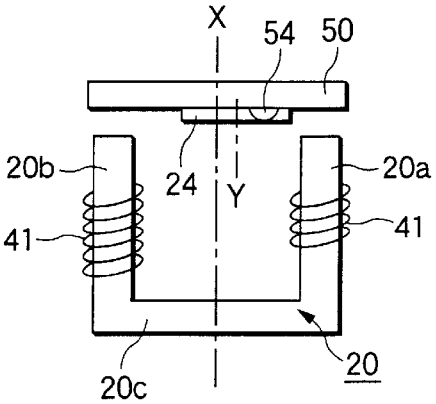
FIG. 30(*a*) is a schematic view, partially omitted, of an example of an electromagnet driving apparatus according to a twentieth-second embodiment of the invention.
Figure 30A:
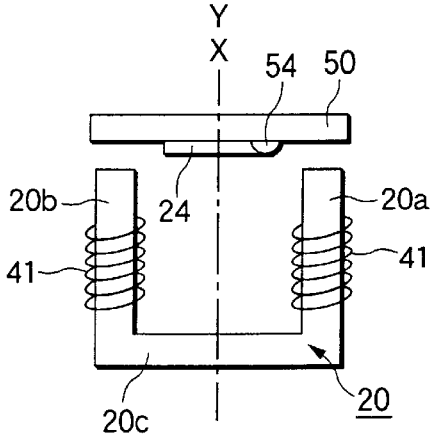
Figure 31B:
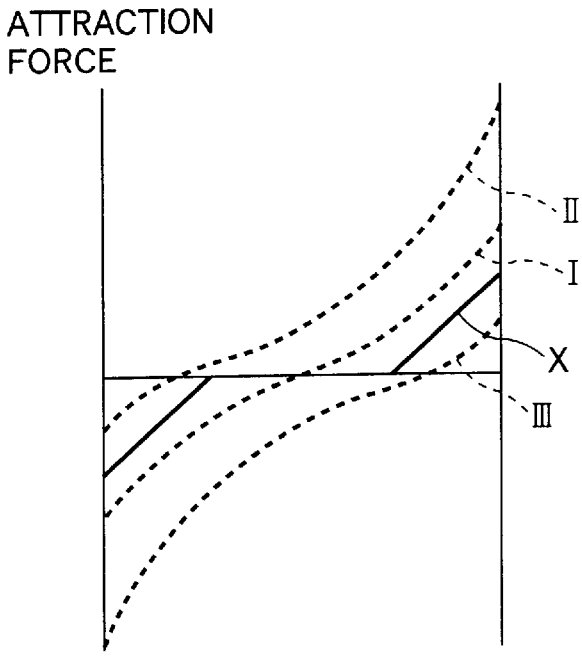
FIG. 31(*a*) is a schematic view of a conventional bistable electromagnetic relay.
Figure 31A:
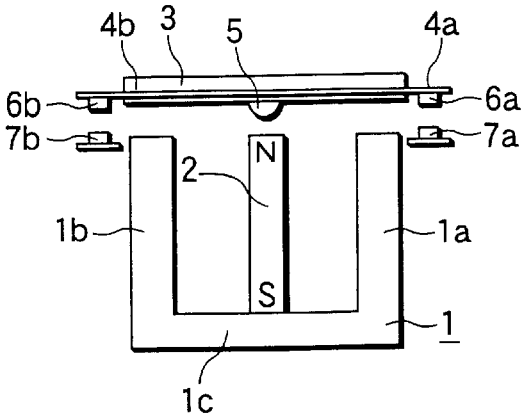
Figure 32B:
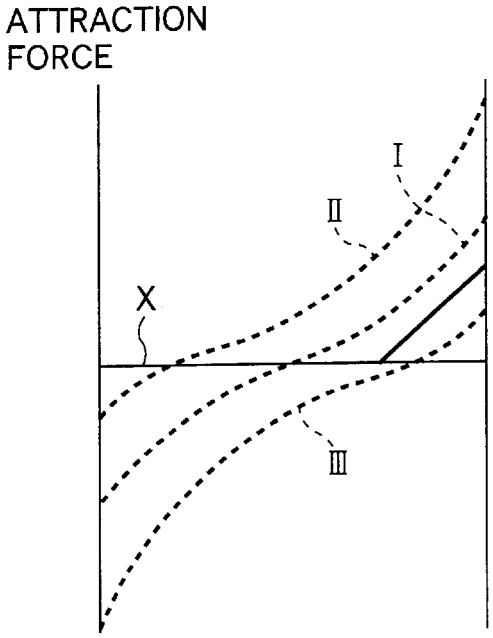
FIG. 32(*a*) is a schematic view of an electromagnetic relay of 2*a* type by the use of the conventional electromagnet driving apparatus.
Figure 32A:
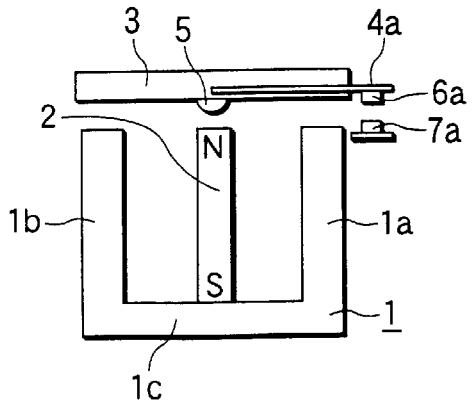

In an electromagnet driving apparatus with the permanent magnet 24 attached integrally to the armature 50, when the coils having the same characteristic are wounded around the pole pieces 20*a,* 20*b* on both sides of the iron core 20, the central line X passing between the pole pieces 20*a,* 20*b* on both sides of the iron core 30 is made coincident with the central position Y of the permanent magnet 24, and the fulcrum 54 of the armature 50 is shifted between the central position Y and the pole piece 20*a,* in the twenty-second embodiment as shown in FIG. 30(*a*). Namely, the fulcrum 54 is off-centered to effect an unbalanced attraction force characteristic.

In the case where the position of the permanent magnet 24 is shifted to the side of the pole piece 20*a,* as shown in FIG. 27, a coil 41 wounded around the pole piece 20*a* has a smaller number of turns, and a coil 41 wounded around the pole piece 20*b* has a greater number of turns, so that the characteristics of the left and right coils 41, 41 may be asymmetrical to effect an unbalanced attraction force characteristic, as shown in FIG. 30(*b*).

In any example as shown in FIGS. 30(*a*) and 30(*b*), the contact structure as shown in FIG. 6 can be adopted to constitute the electromagnetic relay.

What is claimed is:

1. An electromagnetic driving apparatus, comprising:

an iron core having a central portion separating two outside portions formed as a first pole piece with a first pole face at an end of the first pole piece spaced from the central portion and an opposite pole piece with an opposite pole face at an end of the opposite pole piece spaced from the central portion;

at least one coil wound around the iron core;

an armature configured to have a first armature end opposed to the first pole face and an opposite armature end opposed to the opposite pole face;

an armature supporting structure acting as a fulcrum being positioned to engage the armature at an engagement position along a length direction of the armature extending from the first armature end opposed to the first pole face to the opposite armature end opposed to the opposite pole face, the engagement position being spaced a different distance measured in th length direction from the first armature end than from the opposite armature end, with the armature supporting structure acting as a fulcrum being configured to permit the armature to rock in seesaw fashion so that when the first armature end opposed to the first pole face moves toward the first pole face, the opposite armature end opposed to the opposite pole face moves away from the opposite pole face and when the first armature end opposed to the first pole face moves away from the first pole face, the opposite armature end opposed to the opposite pole face moves toward the opposite pole face; and a permanent magnet provided as part of a magnetic circuit including the armature and at least each pole face.

2. The electromagnet driving apparatus as claimed in claim 1, wherein the permanent magnet has a first end and an opposite end magnetized so as to have different magnetic poles, with the first end of the permanent magnet being on the central portion of the iron core and the opposite end of the permanent magnet being opposed to the armature.

3. The electromagnet driving apparatus as claimed in claim 1, wherein the armature supporting structure acting as a fulcrum and the permanent magnet lie centered along a common axis.

4. The electromagnetic driving apparatus of claim 1 further comprising:

a contact terminal having a fixed contact opening or closing a moving contact of a contact spring that is movable by the operation of the armature, wherein the iron core and the contact terminal are integrally secured to a body made of a resin molding.

5. The electromagnet driving apparatus as claimed in claim 4, wherein the iron core is a stamped iron core, a cast iron core or a sintered iron core.

6. The electromagnet driving apparatus as claimed in claim 4, wherein the iron core has a U-shape, further comprising:

pole pieces of the iron core are secured to the body by integral molding to be exposed from the body, a permanent magnet disposed parallel to the pole pieces of the iron core in the longitudinal direction;

at least one coil wound on the iron core; and the armature supporting structure acting as a fulcrum of the armature is at the tip end of the permanent magnet.

7. The electromagnet driving apparatus as claimed in claim 5, wherein the permanent magnet is secured onto the body by integral molding.

8. The electromagnet driving apparatus as claimed in claim 7, wherein the coil is wound around the outer periphery of a barrel portion of a coil bobbin accommodated within an insulating case shaped as a box with an opening at the bottom and having, on a ceiling plane, an opening window through which the top portion of the pole piece passing through the central through hole of the coil bobbin extends.

9. The electromagnet driving apparatus as claimed in claim 8, wherein the insulating case has a resilient projecting piece having an engagement projection at least on the lower edge of each of a pair of opposed side walls for the insulating case, the engagement projection being internally engaged by an engaging protrusion formed on either side face of a collar portion for the coil bobbin located on the side of the body.

10. The electromagnet driving apparatus as claimed in claim 8, further comprising:

a rib provided to surround an opening of the central through hole through which the top portion of the pole piece extends, except for a region to which an end portion of the armature is faced, the rib higher than the top position of the pole piece being extended from the collar portion on the upper side of the coil bobbin, and the rib, along with the top portion of the pole piece, being extended through an opening window of the insulating case outward.

11. The electromagnet driving apparatus as claimed in claim 9, wherein a coil terminal is protruded on either side face of the collar portion in the coil bobbin, the coil terminal having a top portion passed through the body and exposed to a bottom face side of the body, and an end portion of the collar portion is within a notch formed on an upright wall stood on an outer edge of the body and interposed between a projection on an inner wall face of the case attached on the body and the body.

* * * * *